US012507737B2

(12) United States Patent
Lei et al.

(10) Patent No.: US 12,507,737 B2
(45) Date of Patent: Dec. 30, 2025

(54) ELECTRONIC VAPORIZATION APPARATUS WITH STRUCTURE TO PREVENT INHALATION OF CONDENSATE AND VAPORIZER THEREOF

(71) Applicant: SHENZHEN SMOORE TECHNOLOGY LIMITED, Guangdong (CN)

(72) Inventors: Guilin Lei, Shenzhen (CN); Boxue Gong, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 586 days.

(21) Appl. No.: 17/705,616

(22) Filed: Mar. 28, 2022

(65) Prior Publication Data

US 2022/0218036 A1 Jul. 14, 2022

Related U.S. Application Data

(63) Continuation of application No. PCT/CN2019/109703, filed on Sep. 30, 2019.

(51) Int. Cl.
*A24F 40/485* (2020.01)
*A24F 40/10* (2020.01)
(Continued)

(52) U.S. Cl.
CPC ..... *A24F 40/485* (2020.01); *A24F 40/10* (2020.01); *A24F 40/42* (2020.01); *A24F 40/30* (2020.01); *A24F 40/40* (2020.01); *A24F 40/48* (2020.01)

(58) Field of Classification Search
CPC ..... A24F 40/485; A24F 40/10; A24F 40/42; A24F 40/30; A24F 40/40; A24F 40/48
See application file for complete search history.

(56) References Cited

U.S. PATENT DOCUMENTS

2013/0306064 A1* 11/2013 Thorens ..... A24F 40/485 128/202.21
2015/0230522 A1 8/2015 Horn et al.
(Continued)

FOREIGN PATENT DOCUMENTS

CN 101325118 A 12/2008
CN 101349447 A 1/2009
(Continued)

OTHER PUBLICATIONS

Chinese Patent Office, Second Office Action in Chinese Patent Application No. 201910944489.0 (Apr. 24, 2022).
(Continued)

*Primary Examiner* — Justin M Kratt
(74) *Attorney, Agent, or Firm* — Leydig, Voit & Mayer, Ltd.

(57) ABSTRACT

A vaporizer includes: a vaporization component; and an air outlet channel. During inhaling of a user of the vaporizer, vapor formed by the vaporization component reaches a mouth of the user through the air outlet channel. An inner sidewall of the air outlet channel is provided with at least one first liquid absorbing groove. The at least one first liquid absorbing groove absorbs condensed liquid formed on the inner sidewall of the air outlet channel through capillary force.

20 Claims, 12 Drawing Sheets

(51) Int. Cl.

| | |
|---|---|
| ***A24F 40/42*** | (2020.01) |
| *A24F 40/30* | (2020.01) |
| *A24F 40/40* | (2020.01) |
| *A24F 40/48* | (2020.01) |

(56) References Cited

U.S. PATENT DOCUMENTS

| | | | |
|---|---|---|---|
| 2016/0145677 | A1 | 5/2016 | Chee et al. |
| 2016/0366944 | A1 | 12/2016 | Larson |
| 2017/0119055 | A1 | 5/2017 | Liu |
| 2017/0143038 | A1 | 5/2017 | Dickens |
| 2017/0273360 | A1 | 9/2017 | Brinkley et al. |
| 2017/0367402 | A1 | 12/2017 | Lau et al. |
| 2018/0116289 | A1 | 5/2018 | Qiu |
| 2019/0014826 | A1 | 1/2019 | Thorens et al. |
| 2021/0274846 | A1 | 9/2021 | Potter |

FOREIGN PATENT DOCUMENTS

| | | | |
|---|---|---|---|
| CN | 102264249 | A | 11/2011 |
| CN | 102264420 | A | 11/2011 |
| CN | 202265459 | U | 6/2012 |
| CN | 102788780 | A | 11/2012 |
| CN | 103237469 | A | 8/2013 |
| CN | 103653260 | A | 3/2014 |
| CN | 103781375 | A | 5/2014 |
| CN | 203913387 | U | 11/2014 |
| CN | 105012987 | A | 11/2015 |
| CN | 105012989 | A | 11/2015 |
| CN | 105192895 | A | 12/2015 |
| CN | 105212277 | A | 1/2016 |
| CN | 105433443 | A | 3/2016 |
| CN | 105841535 | A | 8/2016 |
| CN | 205456063 | U | 8/2016 |
| CN | 105934171 | A | 9/2016 |
| CN | 105962419 | A | 9/2016 |
| CN | 106072767 | A | 11/2016 |
| CN | 106455725 | A | 2/2017 |
| CN | 206119187 | U | 4/2017 |
| CN | 206119188 | U | 4/2017 |
| CN | 106820272 | A | 6/2017 |
| CN | 206390306 | U | 8/2017 |
| CN | 206576295 | U | 10/2017 |
| CN | 107613797 | A | 1/2018 |
| CN | 207100509 | U | 3/2018 |
| CN | 208175992 | U | 12/2018 |
| CN | 208286373 | U | 12/2018 |
| CN | 208425527 | U | 1/2019 |
| CN | 106455725 | B | 3/2019 |
| CN | 109757779 | A | 5/2019 |
| CN | 109805456 | A | 5/2019 |
| CN | 208837093 | U | 5/2019 |
| CN | 109864347 | A | 6/2019 |
| CN | 110051045 | A | 7/2019 |
| CN | 209093053 | U | 7/2019 |
| CN | 110074464 | A | 8/2019 |
| CN | 209234987 | U | 8/2019 |
| CN | 209284324 | U | 8/2019 |
| CN | 110236233 | A | 9/2019 |
| CN | 110250576 | A | 9/2019 |
| CN | 209346086 | U | 9/2019 |
| CN | 209346109 | U | 9/2019 |
| CN | 209359557 | U | 9/2019 |
| CN | 209376684 | U | 9/2019 |
| JP | 2004147634 | A | 5/2004 |
| JP | 2019512220 | A | 5/2019 |
| JP | 2019515692 | A | 6/2019 |
| JP | 2019526243 | A | 9/2019 |
| KR | 1020090130658 | A | 12/2009 |
| KR | 1020110005963 | A | 1/2011 |
| WO | 2018161254 | A1 | 9/2018 |
| WO | 2018211390 | A1 | 11/2018 |
| WO | WO-2020176901 | A2 * | 9/2020 ..... A24F 40/44 |

OTHER PUBLICATIONS

Chinese Patent Office, Second Office Action in Chinese Patent Application No. 201910944516.4 (May 10, 2022).
European Patent Office, Search Report in European Patent Application No. 19947757.1 (Feb. 20, 2023).
Japanese Patent Office, First Office Action in Japanese Patent Application No. 2022-500642 (Mar. 14, 2023).
Patent Cooperation Treaty, International Search Report, International Application No. PCT/CN2019/109703 (Jun. 29, 2020).
Patent Cooperation Treaty, Written Opinion of the International Searching Authority, International Application No. PCT/CN2019/109703 (Jun. 29, 2020).
Chinese Patent Office, First Office Action in Chinese Patent Application No. 201910944489.0 (Sep. 1, 2021).
Chinese Patent Office, First Office Action in Chinese Patent Application No. 201990001344.0 (Dec. 31, 2021).
Patent Cooperation Treaty, International Search Report, International Application No. PCT/CN2019/109705 (Jun. 24, 2020).
Patent Cooperation Treaty, Written Opinion of the International Searching Authority, International Application No. PCT/CN2019/109705 (Jun. 24, 2020).
Chinese Patent Office, First Office Action in Chinese Patent Application No. 201910944516.4 (Sep. 3, 2021).
Chinese Patent Office, First Office Action in Chinese Patent Application No. 201910944487.1 (Jun. 17, 2020).
Chinese Patent Office, Second Office Action in Chinese Patent Application No. 201910944487.1 (Apr. 13, 2021).
Chinese Patent Office, Notice of Rejection in Chinese Patent Application No. 201910944487.1 (Oct. 11, 2021).
Patent Cooperation Treaty, International Search Report, International Application No. PCT/CN2019/110657 (Jun. 23, 2020).
Patent Cooperation Treaty, Written Opinion of the International Searching Authority, International Application No. PCT/CN2019/110657 (Jun. 23, 2020).
Jun Zhuang et al., "Heat pipe technology and its engineering application", Chemical Industry Press, Beijing, China, p. 236, Jun. 2000.
Ning Zhuo et al., "Engineering Convective Heat Transfer", Shanghai Institute of Mechanical Engineering, Machinery Industry Press, First edition, p. 200, Dec. 1982.
European Patent Office, Search Report in European Patent Application No. 19947639.1 (May 24, 2023).
Chinese Patent Office, Rejection Decision in Chinese Patent Application No. 201910944489.0 (Sep. 27, 2022).
Chinese Patent Office, Third Office Action in Chinese Patent Application No. 201910944516.4 (Nov. 2, 2022).
European Patent Office, Supplementary Search Report in European Patent Application No. 19948182.1 (Sep. 29, 2022).
Miao et al., "Spacecraft Thermal Control Technology," Beijing Institute of Technology Press, Mar. 2018, pp. 14-15.
Dai et al., "Principles and Technologies of Solar Thermal Energy Utilization," Shanghai Jiaotong University Press, Dec. 2018, p. 339.
Li, Chongxiang, "Principles and Technologies of Energy Conservation," Xi'an Jiaotong University Press, Mar. 2004, p. 180.
Japanese Patent Office, Notice of Reasons for Refusal in Japanese Patent Application No. 2022-500642 (Sep. 19, 2023).
Japanese Patent Office, Decision to Grant a Patent in Japanese Patent Application No. 2022-500642 (Nov. 21, 2023).
Chinese Patent Office, Rejection Decision in Chinese Patent Application No. 201910944487.1 (Oct. 11, 2021).
Chinese Patent Office, Notice of Reexamination in Chinese Patent Application No. 201910944487.1 (Nov. 22, 2023).
Korean Patent Office, Office Action in Korean Patent Application No. 10-2021-7041530 (Nov. 29, 2023).

(56) References Cited

OTHER PUBLICATIONS

European Patent Office, Office Action in European Patent Application No. 19947757.1 (Sep. 26, 2023).
U.S. Patent and Trademark Office, Office Action in U.S. Appl. No. 17/706,626 (Jun. 27, 2024).
U.S. Patent and Trademark Office, Office Action in U.S. Appl. No. 17/706,635 (Aug. 23, 2024).

* cited by examiner

ELECTRONIC VAPORIZATION APPARATUS WITH STRUCTURE TO PREVENT INHALATION OF CONDENSATE AND VAPORIZER THEREOF

CROSS-REFERENCE TO PRIOR APPLICATION

This application is a continuation of International Patent Application No. PCT/CN2019/109703, filed on Sep. 30, 2019. The entire disclosure of that application is hereby incorporated by reference herein.

FIELD

The present invention relates to vaporization apparatuses, and more specifically, to an electronic vaporization apparatus and a vaporizer thereof.

BACKGROUND

An electronic vaporization apparatus is generally configured to heat and vaporize e-liquid stored in the electronic vaporization apparatus and form vapor for a user to inhale, and the user generally inhales the vapor by using an air outlet channel in an airflow channel of the electronic vaporization apparatus. When the vapor approaches the air outlet channel, the vapor may be partially condensed when encountering a sidewall of the air outlet channel to form a condensate, and if the condensate is not processed, the user may easily inhale the condensate into a mouth, thereby affecting user experience.

SUMMARY

In an embodiment, the invention provides a vaporizer, comprising: a vaporization component; and an air outlet channel, wherein during inhaling of a user of the vaporizer, vapor formed by the vaporization component reaches a mouth of the user through the air outlet channel, wherein an inner sidewall of the air outlet channel is provided with at least one first liquid absorbing groove, and wherein the at least one first liquid absorbing groove is configured to absorb condensed liquid formed on the inner sidewall of the air outlet channel through capillary force.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
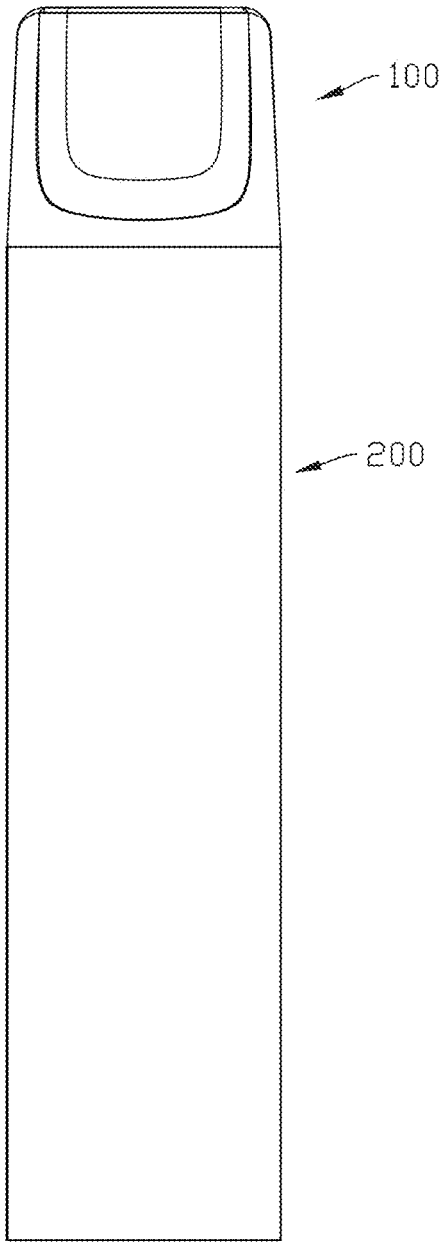
FIG. 1 is a three-dimensional schematic structural diagram of an electronic vaporization apparatus according to some embodiments of the present invention.
Figure 2:
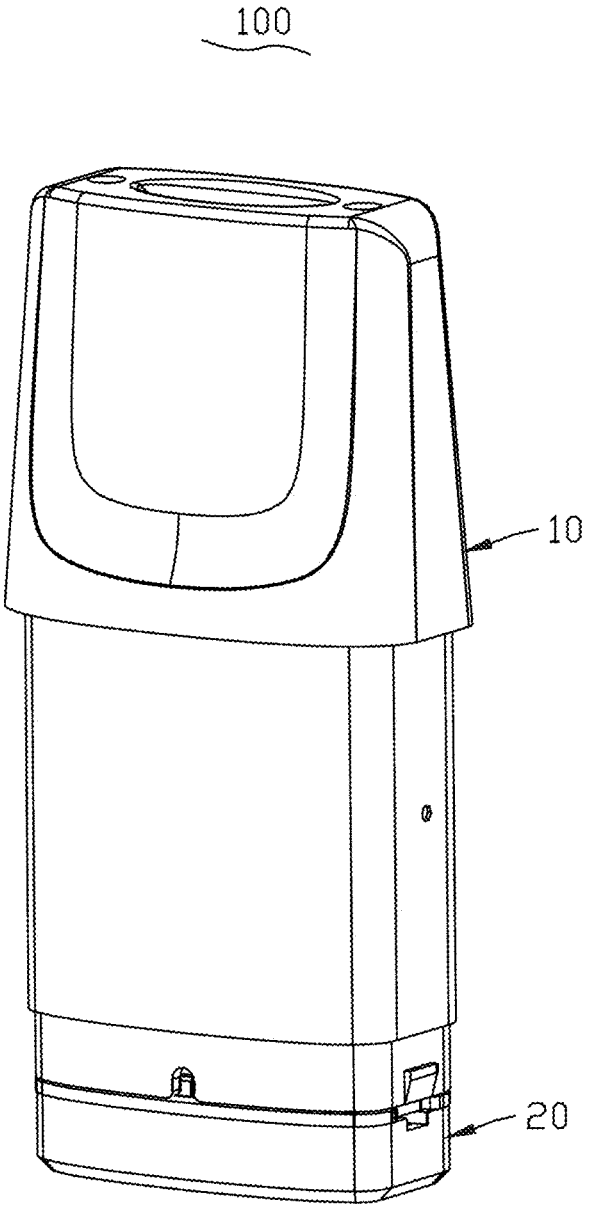
FIG. 2 is a three-dimensional schematic structural diagram of a vaporizer in the electronic vaporization apparatus shown in FIG. 1.
Figure 3:
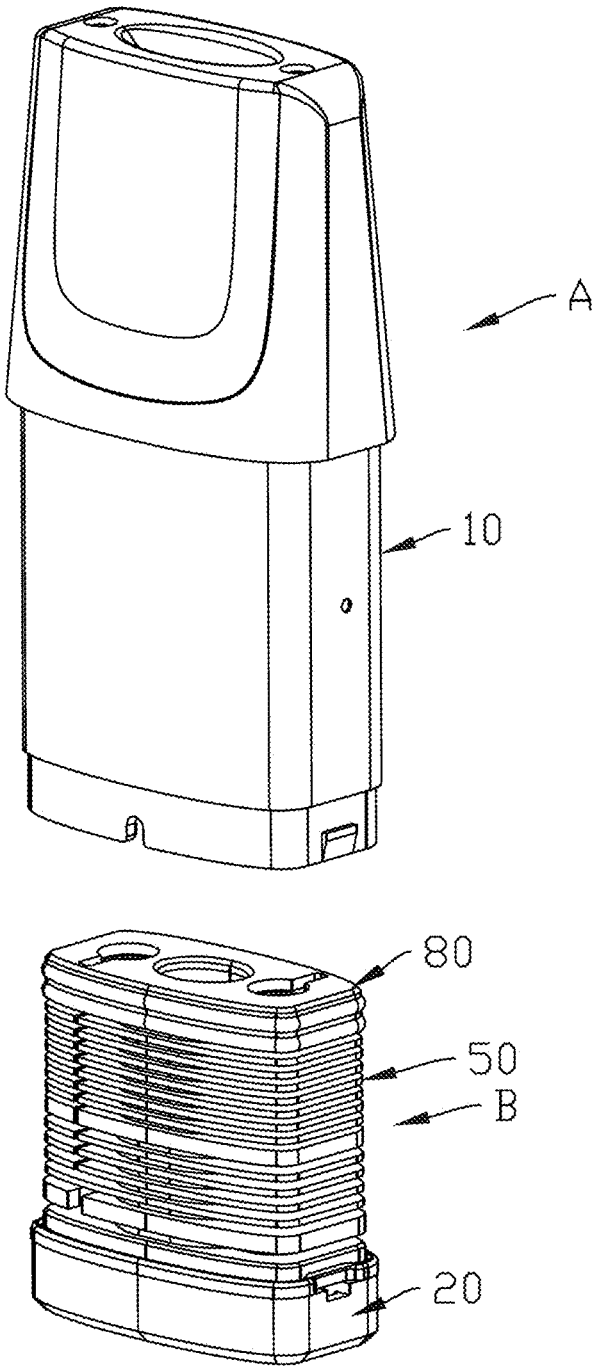
FIG. 3 is a partial schematic exploded view of the vaporizer shown in FIG. 2.
Figure 4:
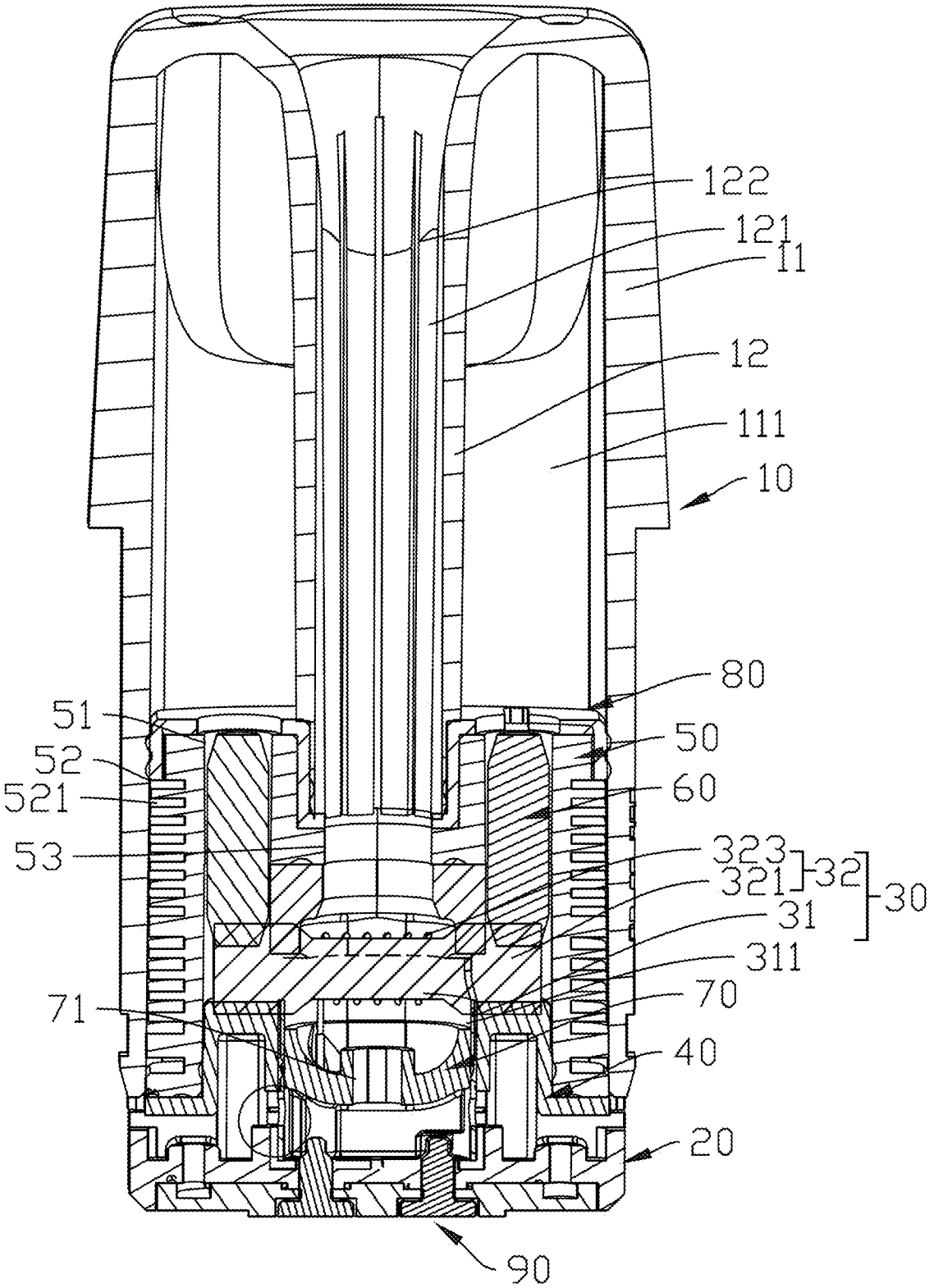
FIG. 4 is a cross-sectional view of the vaporizer shown in FIG. 2.
Figure 5:
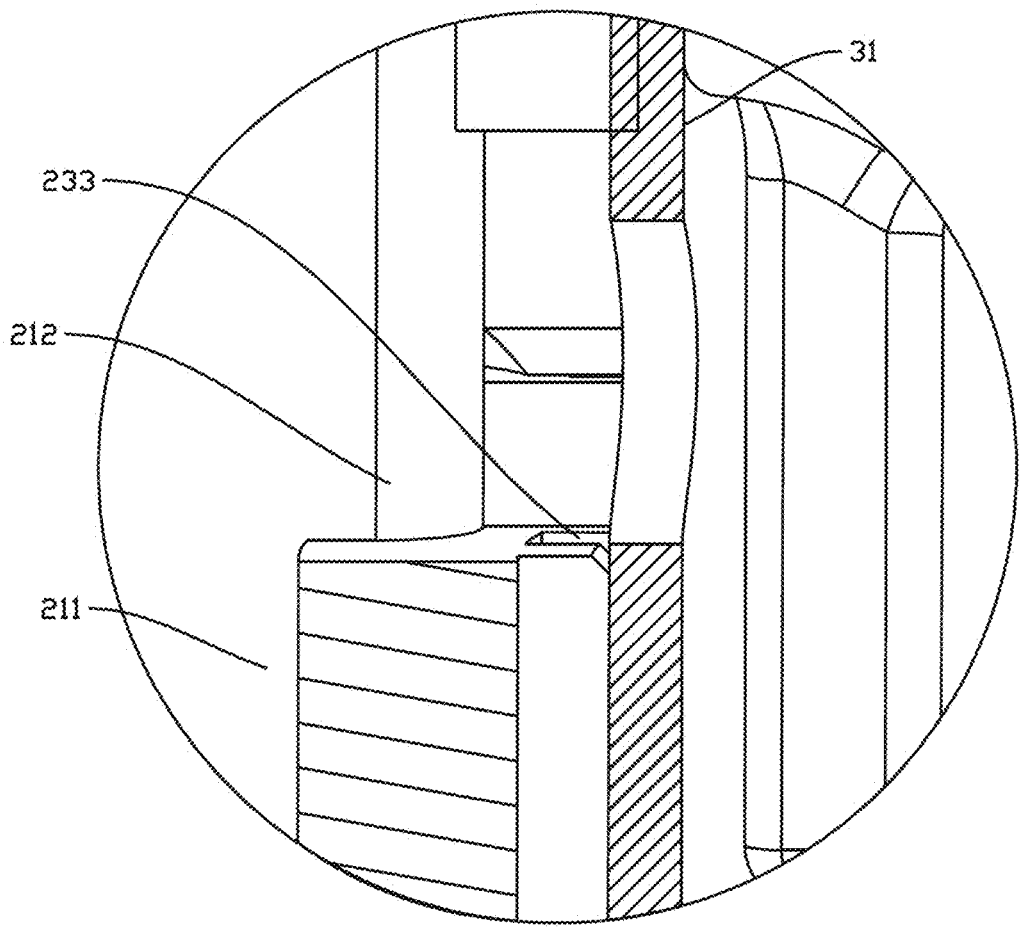
FIG. 5 is a partial schematic enlarged view of the vaporizer shown in FIG. 4.
Figure 6:
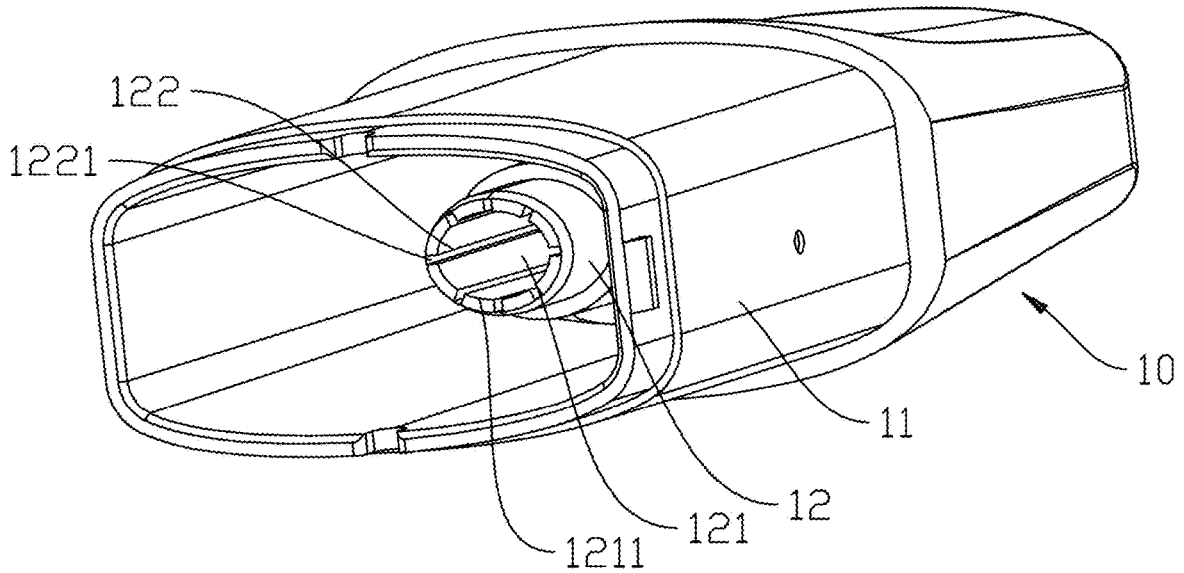
FIG. 6 is a three-dimensional schematic structural diagram of a housing of the vaporizer shown in FIG. 4.
Figure 7:
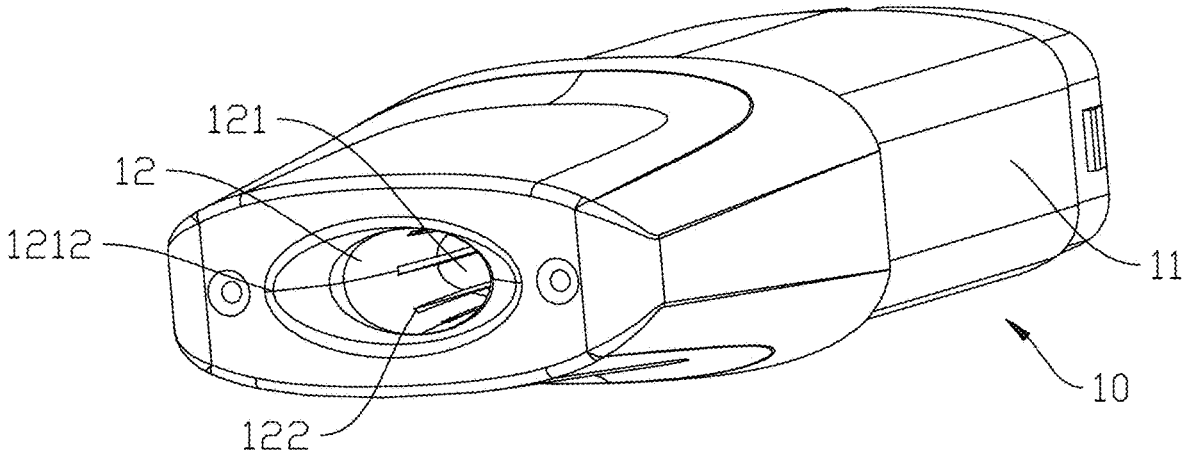
FIG. 7 is a three-dimensional schematic structural diagram in another angle of the housing of the vaporizer shown in FIG. 4.
Figure 8:
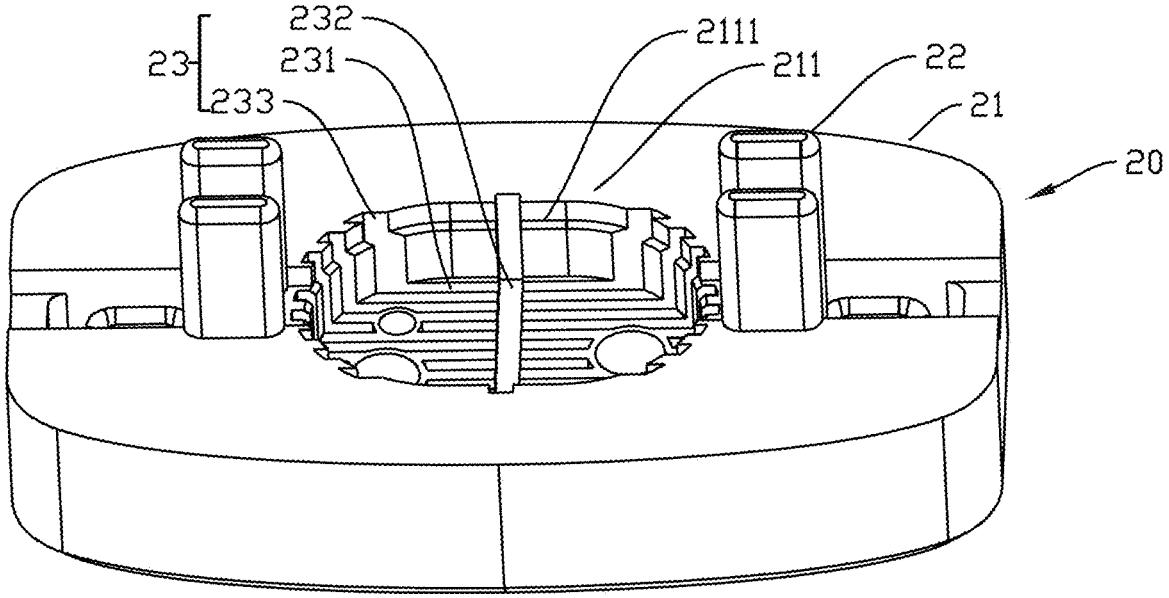
FIG. 8 is a three-dimensional schematic structural diagram of a base of the vaporizer shown in FIG. 4.

In an embodiment, the invention provides an improved vaporizer and further provide an improved electronic vaporization apparatus.

In an embodiment, the invention provides a vaporizer, including a vaporization component and an air outlet channel, where during inhaling of a user, vapor formed by the vaporization component reaches a mouth of the user through the air outlet channel; an inner sidewall of the air outlet channel is provided with at least one first liquid absorbing groove; and the first liquid absorbing groove absorbs condensed liquid formed on the inner sidewall of the air outlet channel through capillary force.

Preferably, the air outlet channel includes a first end close to the vaporization component and a second end away from the vaporization component, the first liquid absorbing groove is disposed extending from the first end of the air outlet channel to the second end of the air outlet channel, and the condensed liquid absorbed by the first liquid absorbing groove flows to the vaporization component under action of gravity.

Preferably, the first liquid absorbing groove and a central axis of the air outlet channel are parallel.

Preferably, the first liquid absorbing groove is spirally disposed.

Preferably, the vaporization component vaporizes the condensed liquid flowing from the first liquid absorbing groove again.

Preferably, the vaporizer further includes a vaporization cavity, and the first liquid absorbing groove is in direct communication with the vaporization cavity.

Preferably, there are a plurality of first liquid absorbing grooves, and the plurality of first liquid absorbing grooves are disposed at intervals and parallel to each other.

Preferably, a groove depth of each first liquid absorbing groove is set as gradually decreasing in a direction away from the second end.

Preferably, a groove width of each first liquid absorbing groove is set as gradually increasing in a direction away from the second end.

Preferably, a groove depth of each first liquid absorbing groove is greater than or equal to 0.1 mm.

Preferably, a groove width of each first liquid absorbing groove is 0.05 mm to 1 mm.

Preferably, a groove width of each first liquid absorbing groove is set as gradually increasing in an opening direction of the first liquid absorbing groove.

Preferably, the vaporizer further includes a housing and a base, where the housing is sleeved on the base, the vaporization component is disposed on the base, and a sidewall of the air outlet channel and the housing are integrally formed.

Preferably, the housing includes a body and an air outlet tube longitudinally disposed in the body; the air outlet channel is disposed in the air outlet tube; the at least one first liquid absorbing groove is disposed on an inner sidewall of the air outlet tube; and an inner side of the body and an outside of the air outlet tube form a liquid storage cavity in fluid connection to the vaporization component.

The present invention further constructs an electronic vaporization apparatus, including a vaporization component and an air outlet channel. where during inhaling of a user, vapor formed by the vaporization component reaches a mouth of the user through the air outlet channel; and an inner sidewall of the air outlet channel is provided with at least one first liquid absorbing groove, and the first liquid absorbing groove absorbs condensed liquid formed on the inner sidewall of the air outlet channel through capillary force.

Preferably, the air outlet channel includes a first end close to the vaporization component and a second end away from the vaporization component, the first liquid absorbing groove is disposed extending from the first end of the air outlet channel to the second end of the air outlet channel, and the condensed liquid absorbed by the first liquid absorbing groove flows to the vaporization component under action of gravity.

Preferably, the first liquid absorbing groove and a central axis of the air outlet channel are parallel.

Preferably, the first liquid absorbing groove is spirally disposed.

Preferably, the vaporization component vaporizes the condensed liquid flowing from the first liquid absorbing groove again; and the vaporizer further includes a vaporization cavity, and the first liquid absorbing groove is in direct communication with the vaporization cavity.

Preferably, a groove depth of each first liquid absorbing groove is set as gradually decreasing in a direction away from the second end;

a groove width of each first liquid absorbing groove is set as gradually increasing in a direction away from the second end; and/or a groove width of each first liquid absorbing groove is set as gradually increasing in a direction from a bottom to an opening of the first liquid absorbing groove.

Implementation of the electronic vaporization apparatus and the vaporizer of the present invention has the following beneficial effects: in the vaporizer, at least one first liquid absorbing groove is opened on the inner sidewall of the air outlet channel, and the first liquid absorbing groove absorbs condensed liquid formed on the sidewall of the air outlet channel through capillary force, to further prevent the condensed liquid from being inhaled by a user into a mouth, thereby improving user experience.

The electronic vaporization apparatus has advantages such as high user experience and low manufacturing costs.

In order to have a clearer understanding of the technical features, the objectives, and the effects of the present invention, specific implementations of the present invention are now illustrated with reference to the accompanying drawings.

Orientation limitation: the upper, lower, top, and bottom orientations shown in the accompanying drawings are the upper, lower, top, and bottom of the present invention. It should be understood that orientation or position relationships indicated by "upper" and "lower" are based on orientation or position relationships shown in the accompanying drawings or constructed and operated in specific orientations, and are used only for ease of description of the technical solution, rather than indicating or implying that the mentioned apparatus or element needs to have a particular orientation. Therefore, such terms should not be construed as limiting of the present invention.

FIG. 1 to FIG. 4 show a first embodiment of an electronic vaporization apparatus according to the present invention. The electronic vaporization apparatus is applicable to vaporization of a liquid medium such as e-liquid or medicine, and includes a vaporizer 100 and a power supply apparatus 200 mechanically and electrically connected to the vaporizer 100. The vaporizer 100 is configured to heat and vaporize a liquid medium, and the power supply apparatus 200 is configured to supply power to the vaporizer 100. Preferably, the vaporizer 100 and the power supply apparatus 200 are detachably connected to each other. The power supply apparatus 200 includes a power supply housing, a battery disposed in the power supply housing, a conductive contact disposed in the power supply housing and connected to the battery and the vaporizer 100, and a control circuit disposed in the power supply housing and electrically connected to the battery and the vaporizer 100.

As shown in FIG. 3 to FIG. 7, in this embodiment, the vaporizer includes a housing 10, a base 20, a vaporization component 30, a first sealing element 40, an air-liquid balancing element 50, and a liquid guiding element 60. The housing 10 is sleeved on an outside of the vaporization component 30, and an inner side of the housing is configured to form a liquid storage cavity 111 for accommodating the liquid medium. In this embodiment, the liquid medium is e-liquid. The base 20 is provided for mount the vaporization component 30, and the housing 10 is sleeved on the base 20. The vaporization component 30 is disposed in the housing 10 and located on the base 20. The first sealing element 40 is disposed on the base 20 and configured to seal a junction between the vaporization component 30 and the base 20. The air-liquid balancing element 50 is disposed in a body 11 and located at a lower part of the liquid storage cavity 111, sleeved on the outside of the vaporization component 30, and located on the base 20. The air-liquid balancing element 50 connects the liquid storage cavity 111 to the outside, to balance air pressure in the liquid storage cavity 111. A quantity of the liquid guiding elements 60 may be two, and it may be understood that, in some other embodiments, the quantity of the liquid guiding elements may be one or more. The liquid guiding element 60 runs through the air-liquid balancing element 50 and is configured to cause the liquid storage cavity 111 to be in fluid connection to the vaporization component 30, to provide a liquid medium for the vaporization component 30. It may be understood that, in some other embodiments, the air-liquid balancing element 50 and the liquid guiding element 60 may be omitted.

Further, in this embodiment, the housing 10 includes a body 11 and an air outlet tube 12; and the body 11 and the air outlet tube 12 are integrally formed through injection molding. It may be understood that, in some other embodiments, the air outlet tube 12 and the body 11 form split structures. The body 11 is sleeved on the base 20 and the vaporization component 30, a space is reserved between the body and an upper part of the vaporization component 30, and the space is used for forming the liquid storage cavity 111. The air outlet tube 12 is disposed in the body 11 in a longitudinal direction and is disposed in communication with the vaporization component 30, and the air outlet tube 12 is located at a central axis of the body 11. It may be understood that, in some other embodiments, the air outlet tube 12 is disposed on one side of the body 11 and not limited to the central axis, and the air outlet tube 12 may be also disposed obliquely. An inner side of the air outlet tube 12 forms an air outlet channel 121, the air outlet channel 121 is disposed in an axial direction of the air outlet tube 12, and a sidewall of the air outlet tube and the housing are integrally formed. When a user inhales, vapor may reach a mouth of the user through the air outlet channel 121. A second end 1212 of the air outlet channel 121 is inserted into the vaporization component 30, and a first end 1211 thereof forms a mouthpiece for the user to inhale vapor. An inner sidewall of the air outlet channel 121 is provided with at least one first liquid absorbing groove 122. In this embodiment, the at least one first liquid absorbing groove 122 may be a plurality of first liquid absorbing grooves 122. It may be understood that, in some other embodiments, there may be a plurality of first liquid absorbing grooves 121, but the quantity is not limited thereto and may also be one. The first liquid absorbing groove 122 includes capillary force used for absorbing condensed liquid formed on the sidewall of the air outlet channel 121 through condensation, the condensed liquid flows onto the vaporization component 30 under action of gravity, and the vaporization component 30 vaporizes the condensed liquid flowing from the first liquid absorbing groove 122 again, to improve utilization of the liquid medium.

Further, in this embodiment, the plurality of first liquid absorbing grooves 122 are disposed on an inner sidewall of the air outlet tube 12 and disposed at intervals in a circumferential direction of the air outlet channel 121. When vapor reaches an air outlet through the air outlet channel 121, airflow around the air outlet channel 121 is condensed when encountering the inner sidewall of the air outlet tube 12 to form condensed liquid, and in this case, the first liquid absorbing groove 122 may absorb the condensed liquid into the groove through capillary force. In this embodiment, the first liquid absorbing groove 122 is disposed longitudinally along the air outlet channel 121 and extends from the second end 1212 of the air outlet channel 121 to the first end 1211 of the air outlet channel 121. The first liquid absorbing groove is parallel to a central axis of the air outlet channel 121 and is in fluid connection to the vaporization component 30 in the vaporization component 30, so that the condensed liquid flows to the upper of the vaporization component 30 in a direction of the first liquid absorbing groove 122 under the action of gravity and drips on the vaporization component 30 to be vaporized again, thereby improving the utilization of the liquid medium, preventing the liquid medium from being inhaled into the mouth of the user, and improving user experience. In this embodiment, the first liquid absorbing groove is not limited to being disposed longitudinally, and may be disposed spirally or obliquely.

In this embodiment, an end surface of the first end 1211 of the air outlet channel 121 is provided with an outlet 1221. The outlet 1221 is in communication with the first liquid absorbing groove 122 and the vaporization component 30, and liquid in the first liquid absorbing groove 122 drips onto the vaporization component 30 through the outlet 1221.

In this embodiment, a groove depth of the first liquid absorbing groove 122 is disposed as gradually decreasing in a direction away from the outlet 1221, and a bottom surface of the first liquid absorbing groove 122 is a slope tilting to a direction of the outlet 1221. As a result, an upper part of the first liquid absorbing groove 122 stores relatively less liquid, and a lower part of the first liquid absorbing groove 122 stores relatively more liquid, thereby preventing the liquid in the upper part of the first liquid absorbing groove 122 from being inhaled into the mouth of the user. In addition, by disposing the bottom surface of the first liquid absorbing groove 122 as a slope tilting to the direction of the outlet 1221, resistance that the upper liquid is inhaled is increased, so as to prevent the liquid from being inhaled into the mouth by the user. Specifically, in this embodiment, the groove depth of each first liquid absorbing groove 122 may be greater than or equal to 0.1 mm. In this embodiment, a groove width of each first liquid absorbing groove 122 is set as gradually increasing in an opening direction of the first liquid absorbing groove 122, so that the first liquid absorbing groove 122 presents a characteristic that an inner part of is narrow and an opening is wide, thereby helping the liquid flow onto the vaporization component 30 along the first liquid absorbing groove 122. In this embodiment, the width of each liquid absorbing groove 122 may be 0.05 mm to 1 mm.

As shown in FIG. 4 to FIG. 8, further, in this embodiment, the base 20 includes a base body 21, a support component 22 disposed on the base body 21, and a liquid storage structure 23. A shape and a size of a cross section of the base body 21 match a shape and a size of an opening end of the housing 10, and the base body is configured to seal the opening of the housing 10. A groove 211 is opened on the base 20. Specifically, the groove 211 is disposed on one side of the base body 21 disposed opposite to a vaporization cavity 311 of the vaporization component 30, for ease of forming the liquid storage structure 23 at a bottom of the vaporization cavity 311; the support component 22 includes two groups of support pillars disposed at intervals; and the two groups of support pillars are respectively located on two opposite sides of the groove 211 for supporting a vaporization element 32 in the vaporization component 30. The liquid storage structure 23 is disposed in the groove 211 and in communication with the vaporization cavity 311 of the vaporization component 30, and is configured to store a liquid medium to prevent the liquid medium from being leaked out.

Further, in this embodiment, the liquid storage structure 23 includes a plurality of second liquid absorbing grooves 231, a liquid diverging groove 232, and a plurality of liquid guiding grooves 233. The plurality of second liquid absorbing grooves 231 are disposed at intervals and in parallel at a bottom of the groove 211, the second liquid absorbing groove 231 and the vaporization cavity 311 are disposed opposite to each other, and the second liquid absorbing groove has capillary force, which can absorb a liquid medium dripped from the vaporization cavity 311 or the air outlet channel 121. There may be a plurality of second liquid absorbing grooves 231, but the quantity is not limited thereto and may also be one. The liquid diverging groove 232 is located on a bottom surface of the groove 211 and disposed intersecting with the plurality of second liquid absorbing grooves 231. The liquid diverging groove crosscuts the second liquid absorbing grooves 231 and is in communication with the liquid absorbing grooves 231 for liquid diverging and absorbing the liquid medium more quickly. The plurality of liquid guiding grooves 233 are disposed on a sidewall 212 of the groove 211 at intervals. The liquid guiding grooves are disposed corresponding to the second liquid absorbing grooves 231 and the liquid diverging groove 232 and are in communication with the second liquid absorbing grooves 231 and the liquid diverging groove 232, and includes capillary force for pouring liquid into the second liquid absorbing grooves 231.

Further, in this embodiment, each second liquid absorbing groove 231 is transversely disposed in an extending manner along the bottom surface of the groove 211, namely, transversely disposed in an extending manner along the vaporization cavity 311. The second liquid absorbing groove controls a flow direction of the liquid medium to effectively prevent liquid leakage. In this embodiment, a groove width of the second liquid absorbing groove 231 is 0.05 mm to 1 mm. In this embodiment, a groove depth of each second liquid absorbing groove 231 is greater than 0.1 mm, and it may be understood that, in some other embodiments, the groove depth of the second liquid absorbing groove 231 is also equal to 0.1 mm.

Further, in this embodiment, the liquid diverging groove 232 is disposed perpendicular to each second liquid absorbing groove 231, and divides each second liquid absorbing groove 231 into two sections. A width of the liquid diverging groove 232 is greater than the width of second liquid absorbing groove 231, for ease of improving a liquid absorbing speed, thereby preventing the liquid medium from penetrating to the outside from pores of an electrode.

Further, in this embodiment, the liquid guiding grooves 233 are disposed on the sidewall 212 of the groove 211 and longitudinally extend along the base 20, and each second liquid absorbing groove 231 is in communication with each liquid diverging groove 232 correspondingly, to guide the liquid medium into the second liquid absorbing grooves 231 and the liquid diverging groove 232. In this embodiment, an opening of one end of the liquid guiding groove 233 away from the second liquid absorbing groove 231 and the liquid diverging groove 232 is disposed on an outer side of the vaporization cavity 311 for absorbing leaked liquid on the outer side of the vaporization cavity 311. In this embodiment, an inner sidewall 212 of the groove 211 is provided with a stage 2111, and the stage is configured to fit and assemble with a vaporization housing 31 of the vaporization component 30, to improve the assembly tightness. In this embodiment, the liquid guiding groove 233 includes capillary force for absorbing leaked liquid and guiding the leaked liquid into the second liquid absorbing groove 231. In this embodiment, a groove width of the liquid guiding groove 233 may be 0.05 mm to 1 mm, and it may be understood that, in some other embodiments, the groove width of the liquid guiding groove 233 is not limited to 0.05 mm to 1 mm.

Further, in this embodiment, the vaporization component 30 includes a vaporization housing 31 and a vaporization element 32; and the vaporization housing 31 is sleeved on the base 20 and inserted into the groove 211. The vaporization housing 31 is configured to mount the vaporization element 32 to fix the vaporization element 32; an inner side of the vaporization housing 31 forms the vaporization cavity 311; and the vaporization cavity 311 is located on the base 20 and in direct communication with the first liquid absorbing groove 122. Liquid leakage may easily occur at a place where the vaporization housing 31 is in contact with the vaporization element 32, the liquid medium may be leaked out easily from a junction of the first sealing element 40 and the vaporization housing 31, and the opening of the end of the liquid guiding groove 233 away from the second liquid absorbing groove 231 and the liquid diverging groove 232 is disposed opposite to the junction of the vaporization housing 31 and the first sealing element 40. Specifically, the opening directly faces the junction and absorbs leaked liquid at this place through capillary force. The vaporization element 32 transversely runs through the vaporization housing 31, and the vaporization element 32 includes a vaporization core 321 running through the vaporization housing 31 and a heating element 322 wound on the vaporization core 321. The vaporization core 321 may be a cotton core, and two ends of the vaporization core 321 are located on the two groups of support pillars on the base body 211 and in fluid connection to the liquid guiding element 60. A conductive connection portion of the heating element 322 runs through the base 20 to be connected to an electrode 90. In this embodiment, the heating element 322 may be a heating wire.

Further, in this embodiment, the first sealing element 40 is sleeved on the base 20 and sleeved on an outside of the vaporization housing 31. Specifically, the first sealing element 40 may be a sealing sleeve. The sealing sleeve may be a silicone sleeve or rubber sleeve. It may be understood that, in some other embodiments, the sealing sleeve is not limited to the silicone sleeve or the rubber sleeve.

Further, in this embodiment, the air-liquid balancing element 50 is in a shape of a cylinder. Specifically, A cross section thereof is an oval or rectangular cylinder, and a peripheral thereof and an inner wall surface of the housing 10 may be combined in an interference fitting manner, to seal the liquid storage cavity 111. In this embodiment, the air-liquid balancing element 50 includes two through holes 51, a liquid storage ventilation structure 52 located on the peripheral of the through hole 51, and an airflow channel 53 located between the two through holes 51. The through hole 51 is provided for the liquid guiding element 60 to run through, the liquid storage ventilation structure 52 is configured to communicate the liquid storage cavity 111 with the outside, to balance air pressure in the liquid storage cavity 111, and includes a plurality of liquid storage grooves 521 disposed in parallel and generating capillary force to the liquid medium and two air return grooves. The liquid storage groove is configured to store liquid and prevent liquid leakage. The air return groove is disposed longitudinally and crosscuts the liquid storage groove 521 and communicates the liquid storage groove 521 with the liquid storage cavity 111, and the air return groove is provided for air to enter the liquid storage cavity 111. The airflow channel 53 is in communication with the air outlet channel 121, for ease of communicating the air outlet channel 121 with the vaporization cavity 311. A temperature ventilation process is formed by disposing the air-liquid balancing element 60, to prevent fried oil and burned taste caused by lacking of ventilation for a long time (insufficient liquid supply) and large-particle liquid dripping and liquid leakage caused by abrupt large amount of ventilation (excessive liquid supply). In addition, an independent ventilation channel is formed to seal structure gaps, to prevent liquid leakage caused by capillary force of the gaps and environment changes, and leaked liquid and condensed liquid may be prevented from being inhaled out, thereby improving a product yield rate.

Further, in this embodiment, the liquid guiding element 60 is disposed corresponding to the through holes 51 on the air-liquid balancing element 50, runs through the through holes 51, located on two ends of the vaporization core 321, and in fluid connection to the vaporization core 321. The liquid guiding element 60 may be a cotton core, and it may be understood that, in some other embodiments, the liquid guiding element 60 is not limited to the cotton core.

Further, in this embodiment, the vaporizer further includes a fixing sleeve 70; and the fixing sleeve 70 helps fix the conductive connection portion of the heating element 322, for ease of positioning of the conductive connection portion of the heating element 322. The conductive connection portion of the heating element 322 runs through the fixing sleeve 70. The fixing sleeve 70 is provided with a through hole 71 in communication with the vaporization cavity 311, and the through hole 71 is disposed longitudinally and in communication with the air outlet channel 121, for ease of air circulation. In this embodiment, the fixing sleeve 70 may be a silicone sleeve. It may be understood that, in some other embodiments, the fixing sleeve 70 may be omitted.

Further, in this embodiment, the vaporizer further includes a second sealing element 80; and the second sealing element 80 may be a sealing sleeve sleeved on the air-liquid balancing element 50, and is provided with a relief hole disposed corresponding to the liquid guiding element 60 and the air outlet channel 121. The second sealing element 80 may be a silicone sleeve or rubber sleeve.

Further, in this embodiment, the vaporizer further includes an electrode 90. The electrode 90 includes two electrode terminals. The two electrode terminals are respectively a positive terminal and a negative terminal, which are disposed on the base body 211 in parallel. One end of the electrode is connected to the conductive connection portion of the heating element 322 by disposing a lead wire, and the other end is electrically connected to the power supply apparatus.

FIG. 9 to FIG. 12 show a second embodiment of a vaporizer of the present invention. The present invention constructs a vaporizer, including a base 20, a housing 10 sleeved on the base 20 and connected to the base 20 in a sealing manner to form a liquid storage cavity 111, an electrode 90 disposed on a bottom of the base 20, a liquid injection component 109 mounted on the base 20 and injecting liquid to the liquid storage cavity 111, a vaporizer body disposed on the base 20, an airflow channel running through the entire vaporizer, and a liquid absorbing structure 101. The base includes a liquid storage structure, and for the liquid storage structure, reference may be made to the first embodiment, which is not described herein again. The vaporizer body includes a vaporization component 30, and the airflow channel includes an air inlet channel 131, a vaporization cavity 311, and an air outlet channel 121. The liquid absorbing structure 101 is disposed in the air outlet channel 121, a plurality of liquid storage grooves 105 are disposed in a circumferential direction of the liquid absorbing structure 101, and the liquid storage groove 105 absorbs condensed liquid in the air outlet channel 121 and/or e-liquid that is not completely vaporized in an inhaling process through capillary force. In this embodiment, a material of the liquid absorbing structure 101 is one or more of PETG, PCTG, and PC.

Specifically, the liquid absorbing structure 101 includes a plurality of fins 104. The fins 104 are longitudinally disposed in parallel and at intervals, and a liquid storage groove 105 is formed between every two adjacently disposed fins 104. A width of the liquid storage groove 105 is small enough to generate capillary force to the condensed liquid, so that liquid drips carried in vapor generated in an inhaling process may stay in the liquid storage groove 105 due to the structure of the fins 104, thereby forming a liquid film in the liquid storage groove 105 and further being stored in the liquid storage groove 105, and preventing leaked liquid from being inhaled.

The vaporization component 30 includes a cylinder-shaped vaporization core 321, a liquid guiding cotton 323 surrounding the vaporization core 321, and a heating element 322 wound on the vaporization core 321. A conductive connection portion of the heating element 322 runs through the base 20 to be connected to the electrode 90. In some embodiments, the heating element 322 may be a heating wire. In a use process, the vaporization core 321 absorbs e-liquid in the liquid storage cavity 111, and the heating element 322 is powered on and generates heat, to vaporize the e-liquid in the vaporization core 321. A user inhales vapor through an inhaling opening of a top cover of the vaporizer, air enters the vaporization core 321 through the air inlet channel 131 under action of suction force and is mixed with the vaporized e-liquid in the vaporization core 321, and is then exhausted from the inhaling opening of the top cover of the vaporizer after passing through the air outlet channel 121.

In this embodiment, the liquid absorbing structure 101 includes a plurality of fins 104. The fins 104 are longitudinally disposed in parallel or not in parallel and at intervals, and a liquid storage groove 105 is formed between every two adjacently disposed fins 104. A width of the liquid storage groove 105 is small enough to generate capillary force to the condensed liquid, so that liquid drips carried in vapor generated in an inhaling process may stay in the liquid storage groove 105 due to the structure of the fins 104, thereby forming a liquid film in the liquid storage groove 105 and further being stored in the liquid storage groove 105, and preventing leaked liquid from being inhaled. A thickness of the fin 104 and a width of the liquid storage groove 105 are 0.1 mm to 0.5 mm, and preferably, 0.15 mm to 0.3 mm.

To prevent e-liquid accumulated in the liquid storage groove 105 in the liquid absorbing structure 101 from being brought out by inhaling due to an excessive amount, in this embodiment, the liquid absorbing structure 101 includes: at least one liquid reflux groove 106 extending longitudinally. The at least one liquid reflux groove 106 longitudinally cuts at least a part of the liquid storage groove 105, and the liquid reflux groove 106 is used for guiding, when an amount of the e-liquid accumulated in the liquid storage groove 105 is excessive, the e-liquid to reflux to the vaporization core 321 along the liquid reflux groove 106 to be vaporized again. Specifically, two liquid reflux grooves 106 on the same diameter are disposed on an inner wall of the liquid absorbing structure 101, the liquid reflux groove 106 longitudinally cuts from a next fin 104 of a top fin 104 of the liquid absorbing structure 101 to a bottom fin 104, and the top fin 104 of the liquid absorbing structure 101 is configured to prevent condensed liquid in the liquid reflux groove 106 from flowing to the air outlet channel 121.

Figure 12:
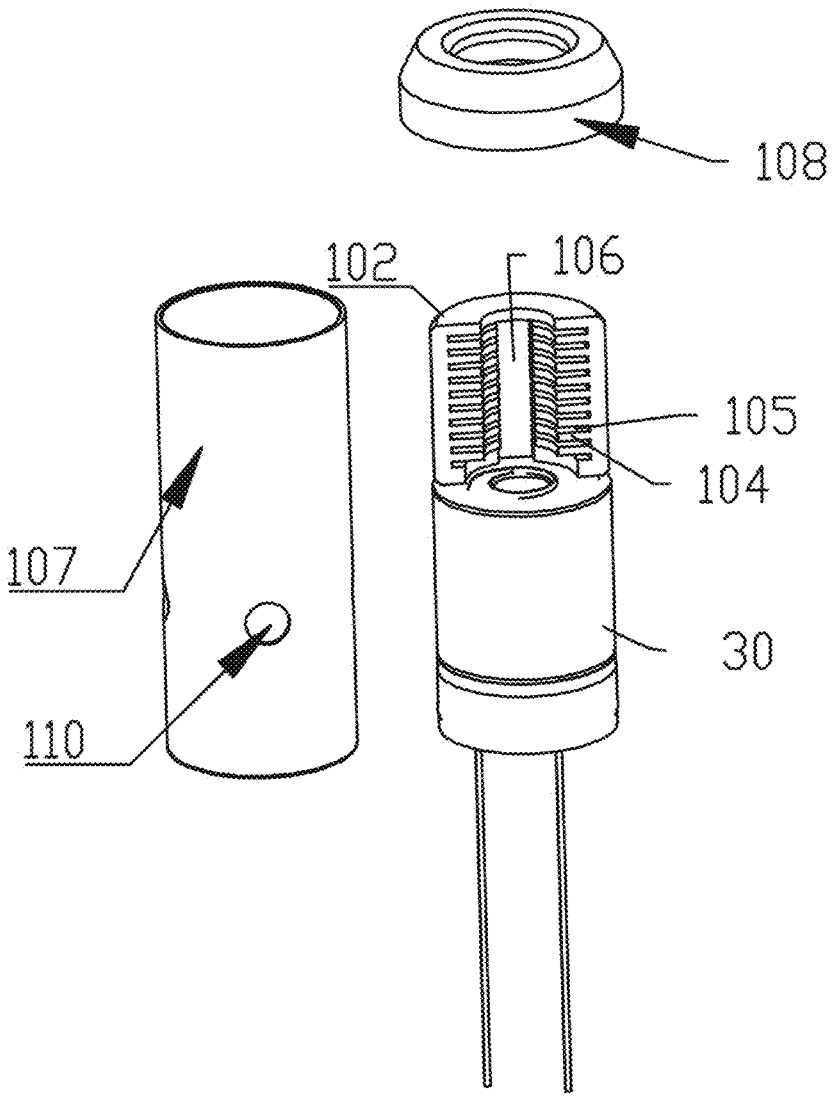
FIG. 12 is a schematic structural diagram of a vaporization component, a sleeve, a liquid absorbing structure, and a sealing element according to the present invention.

Further, as shown in FIG. 12, to make refluxed e-liquid to be better absorbed by the vaporization core 321 and vaporized again, a length by which the bottom fin 104 of the liquid absorbing structure 101 extends to a central axis of the liquid absorbing structure 101 is less than a length by which an adjacent fin 104 extends to the central axis.

In some embodiments, the air outlet channel 121 and the vaporization component 30 are disposed adjacent to each other in a longitudinal direction, the liquid absorbing structure 101 and the air outlet channel 121 are an integral structure, and the liquid storage groove 105 is opened on an inner wall surface of the air outlet channel 121. In this embodiment, as shown in FIG. 12, the liquid absorbing structure 101 and the air outlet channel 121 are split structures. The liquid absorbing structure 101 includes a cylinder-shaped body disposed right above the vaporization component 30, the housing 10 includes a body and an air outlet tube 12 longitudinally disposed in an inner cavity of the body, and an air inlet channel 131, a vaporization cavity 311, and an inner cavity of the liquid absorbing structure 101 and the air outlet tube 12 form a complete airflow channel.

A reason for disposing the liquid absorbing structure 101 right above the vaporization core 321 and adjacent to the vaporization core 321 is that: when an e-cigarette is heated, since there is an e-liquid film during vaporization, bubbles generated in the vaporization process may easily bring e-liquid that is completely vaporized out; and when vapor rises, the liquid absorbing structure located right above the vaporization core 321 absorbs the liquid drips carried in the vapor and stores the liquid drips in the liquid storage groove, thereby greatly reducing a possibility of inhaling leaked liquid.

The plurality of fins 104 are disposed on an inner wall surface of the cylinder-shaped body. As shown in FIG. 12, the cylinder-shaped body includes a first part 102 and a second part (not shown in the figure) that may be detachably enclosed together, where an inner wall surface of the first part 102 is provided with a plurality of first fins, and an inner wall surface of the second part is provided with a plurality of second fins. Specifically, the liquid absorbing structure is in a shape of a cylinder and may be formed by two semicircular cylinders through combination, and the fin is in a shape of a sector ring.

The vaporization component 30 and the liquid absorbing structure 101 may be alternatively disposed in the same sleeve 107. The liquid absorbing structure 101 and the vaporization component 30 are disposed adjacent to each other, and the sleeve 107 corresponding to the vaporization component 30 is provided with at least liquid inlet 110 configured to cause the e-liquid in the liquid storage cavity 111 to enter the vaporization core 321.

In addition, to fix the vaporization component 30 and the liquid absorbing structure 101 and make mounting more convenient, an outer sidewall of the liquid absorbing structure 101 and an inner sidewall of the sleeve 107 are disposed attached to each other. In some embodiments, the liquid absorbing structure 101 and the sleeve 107 may be an integral structure.

To seal the connection between the sleeve 107 and the air outlet channel 121, the sleeve 107 corresponding to the top of the liquid absorbing structure 101 is provided with a sealing element 108 connected to the air outlet channel 121 in a sealing manner, and the sealing element may be a silicone sleeve or a rubber sleeve. It may be understood that, in some other embodiments, the sealing sleeve is not limited to the silicone sleeve or the rubber sleeve.

As shown in FIG. 9 to FIG. 12, the present invention further constructs an electronic vaporization apparatus, including a base 20, a housing 10 sleeved on the base 20 and connected to the base 20 in a sealing manner to form a liquid storage cavity 111, an electrode 90 disposed on a bottom of the base 20, a liquid injection component 109 mounted on the base 20 and injecting liquid to the liquid storage cavity 111, a vaporizer body disposed on the base 20, an airflow channel running through the entire vaporizer, and a liquid absorbing structure 101. The vaporizer body includes a vaporization component 30, and the airflow channel includes an air inlet channel 131, a vaporization cavity 311, and an air outlet channel 121. The liquid absorbing structure 101 is disposed in the air outlet channel 121, a plurality of liquid storage grooves 105 are disposed in a circumferential direction of the liquid absorbing structure 101, and the liquid storage groove 105 absorbs condensed liquid in the air outlet channel 121 and/or e-liquid that is not completely vaporized in an inhaling process through capillary force. In this embodiment, a material of the liquid absorbing structure 101 is one or more of PETG, PCTG, and PC. The electronic vaporization apparatus is a disposable vaporization apparatus in which the base, the housing, and the vaporizer body are an integral structure, or may be a vaporization apparatus in which the base, the housing, the vaporizer body are split structures.

Specifically, the liquid absorbing structure 101 includes a plurality of fins 104. The fins 104 are longitudinally disposed in parallel and at intervals, and a liquid storage groove 105 is formed between every two adjacently disposed fins 104. A width of the liquid storage groove 105 is small enough to generate capillary force to the condensed liquid, so that liquid drips carried in vapor generated in an inhaling process may stay in the liquid storage groove 105 due to the structure of the fins 104, thereby forming a liquid film in the liquid storage groove 105 and further being stored in the liquid storage groove 105, and preventing leaked liquid from being inhaled.

The vaporization component 30 includes a cylinder-shaped vaporization core 321, a liquid guiding cotton 323 surrounding the vaporization core 321, and a heating element 322 wound on the vaporization core 321. A conductive connection portion of the heating element 322 runs through the base 20 to be connected to the electrode 90. In some embodiments, the heating element 322 may be a heating wire. In a use process, the vaporization core 321 absorbs e-liquid in the liquid storage cavity 111, and the heating element 322 is powered on and generates heat, to vaporize the e-liquid in the vaporization core 321. A user inhales vapor through an inhaling opening of a top cover of the vaporizer, air enters the vaporization core 321 through the air inlet channel 131 under action of suction force and is mixed with the vaporized e-liquid in the vaporization core 321, and is then exhausted from the inhaling opening of the top cover of the vaporizer after passing through the air outlet channel 121.

In this embodiment, the liquid absorbing structure 101 includes a plurality of fins 104. The fins 104 are longitudinally disposed in parallel or not in parallel and at intervals, and a liquid storage groove 105 is formed between every two adjacently disposed fins 104. A width of the liquid storage groove 105 is small enough to generate capillary force to the condensed liquid, so that liquid drips carried in vapor generated in an inhaling process may stay in the liquid storage groove 105 due to the structure of the fins 104, thereby forming a liquid film in the liquid storage groove 105 and further being stored in the liquid storage groove 105, and preventing leaked liquid from being inhaled. A thickness of the fin 104 and a width of the liquid storage groove 105 are 0.1 mm to 0.5 mm, and preferably, 0.15 mm to 0.3 mm.

To prevent e-liquid accumulated in the liquid storage groove 105 in the liquid absorbing structure 101 from being brought out by inhaling due to an excessive amount, in this embodiment, the liquid absorbing structure 101 includes: at least one liquid reflux groove 106 extending longitudinally. The at least one liquid reflux groove 106 longitudinally cuts at least a part of the liquid storage groove 105, and the liquid reflux groove 106 is used for guiding, when an amount of the e-liquid accumulated in the liquid storage groove 105 is excessive, the e-liquid to reflux to the vaporization core 321 along the liquid reflux groove 106 to be vaporized again. Specifically, two liquid reflux grooves 106 on the same diameter are disposed on an inner wall of the liquid absorbing structure 101, the liquid reflux groove 106 longitudinally cuts from a next fin 104 of a top fin 104 of the liquid absorbing structure 101 to a bottom fin 104, and the top fin 104 of the liquid absorbing structure 101 is configured to prevent condensed liquid in the liquid reflux groove 106 from flowing to the air outlet channel 121.

Further, as shown in FIG. 12, to make refluxed e-liquid to be better absorbed by the vaporization core 321 and vaporized again, a length by which the bottom fin 104 of the liquid absorbing structure 101 extends to a central axis of the liquid absorbing structure 101 is less than a length by which an adjacent fin 104 extends to the central axis.

In some embodiments, the air outlet channel 121 and the vaporization component 30 are disposed adjacent to each other in a longitudinal direction, the liquid absorbing structure 101 and the air outlet channel 121 are an integral structure, and the liquid storage groove 105 is opened on an inner wall surface of the air outlet channel 121. In this embodiment, as shown in FIG. 12, the liquid absorbing structure 101 and the air outlet channel 121 are split structures. The liquid absorbing structure 101 includes a cylinder-shaped body disposed right above the vaporization component 30, the housing 10 includes a body and an air outlet tube 12 longitudinally disposed in an inner cavity of the body, and an air inlet channel 131, a vaporization cavity 311, and an inner cavity of the liquid absorbing structure 101 and the air outlet tube 12 form a complete airflow channel.

A reason for disposing the liquid absorbing structure 101 right above the vaporization core 321 and adjacent to the vaporization core 321 is that: when an e-cigarette is heated, since there is an e-liquid film during vaporization, bubbles generated in the vaporization process may easily bring e-liquid that is completely vaporized out; and when vapor rises, the liquid absorbing structure located right above the vaporization core 321 absorbs the liquid drips carried in the vapor and stores the liquid drips in the liquid storage groove, thereby greatly reducing a possibility of inhaling leaked liquid.

The plurality of fins 104 are disposed on an inner wall surface of the cylinder-shaped body. As shown in FIG. 12, the cylinder-shaped body includes a first part 102 and a second part (not shown in the figure) that may be detachably enclosed together, where an inner wall surface of the first part 102 is provided with a plurality of first fins, and an inner wall surface of the second part is provided with a plurality of second fins. Specifically, the liquid absorbing structure is in a shape of a cylinder and may be formed by two semicircular cylinders through combination, and the fin is in a shape of a sector ring.

The vaporization component 30 and the liquid absorbing structure 101 may be alternatively disposed in the same sleeve 107. The liquid absorbing structure 101 and the vaporization component 30 are disposed adjacent to each other, and the sleeve 107 corresponding to the vaporization component 30 is provided with at least liquid inlet 110 configured to cause the e-liquid in the liquid storage cavity 111 to enter the vaporization core 321.

In addition, to fix the vaporization component 30 and the liquid absorbing structure 101 and make mounting more convenient, an outer sidewall of the liquid absorbing structure 101 and an inner sidewall of the sleeve 107 are disposed attached to each other. In some embodiments, the liquid absorbing structure 101 and the sleeve 107 may be an integral structure.

To seal the connection between the sleeve 107 and the air outlet channel 121, the sleeve 107 corresponding to the top of the liquid absorbing structure 101 is provided with a sealing element 108 connected to the air outlet channel 121 in a sealing manner, and the sealing element may be a silicone sleeve or a rubber sleeve. It may be understood that, in some other embodiments, the sealing sleeve is not limited to the silicone sleeve or the rubber sleeve.

Implementation of the second embodiment has the following beneficial effects:

In the present invention, a liquid absorbing structure is disposed in an air outlet channel, a plurality of liquid storage grooves are disposed in a circumferential direction of the liquid absorbing structure, and the liquid storage groove absorbs condensed liquid in the air outlet channel through capillary force, to enable the condensed liquid generated in an inhaling process and/or e-liquid that is not completely vaporized to stay in the liquid storage groove, so as to form a liquid film in the liquid storage groove and store the condensed liquid and/or e-liquid in the liquid storage groove, thereby preventing a user from inhaling leaked liquid in the inhaling process and improving user's use experience.

In addition, the liquid absorbing structure includes a plurality of fins, the fins are longitudinally disposed in parallel and at intervals, and a liquid storage groove is formed between every two adjacently disposed fins, so that liquid drips carried in vapor generated in the inhaling process may stay in the liquid storage groove due to the structure of the fins.

To further prevent the e-liquid accumulated in the liquid storage groove in the liquid absorbing structure from being brought out by inhaling due to an excessive amount, the liquid absorbing structure in the present invention includes: at least one liquid reflux groove extending longitudinally. The at least one liquid reflux groove longitudinally cuts at least a part of the liquid storage groove, and the liquid reflux groove is used for guiding, when an amount of the e-liquid accumulated in the liquid storage groove is excessive, the e-liquid to reflux to the vaporization core along the liquid reflux groove to be vaporized again.

To make refluxed e-liquid to be better absorbed by the vaporization core and vaporized again, a length by which the bottom fin of the liquid absorbing structure extends to a central axis of the liquid absorbing structure is less than a length by which an adjacent fin extends to the central axis.

In addition, when an e-cigarette is heated, since there is an e-liquid film during vaporization, bubbles generated in the vaporization process may easily bring e-liquid that is completely vaporized out; and when vapor rises, the liquid absorbing structure located right above the vaporization core 321 absorbs the liquid drips carried in the vapor and stores the liquid drips in the liquid storage groove, thereby greatly reducing a possibility of inhaling leaked liquid.

Figure 9:
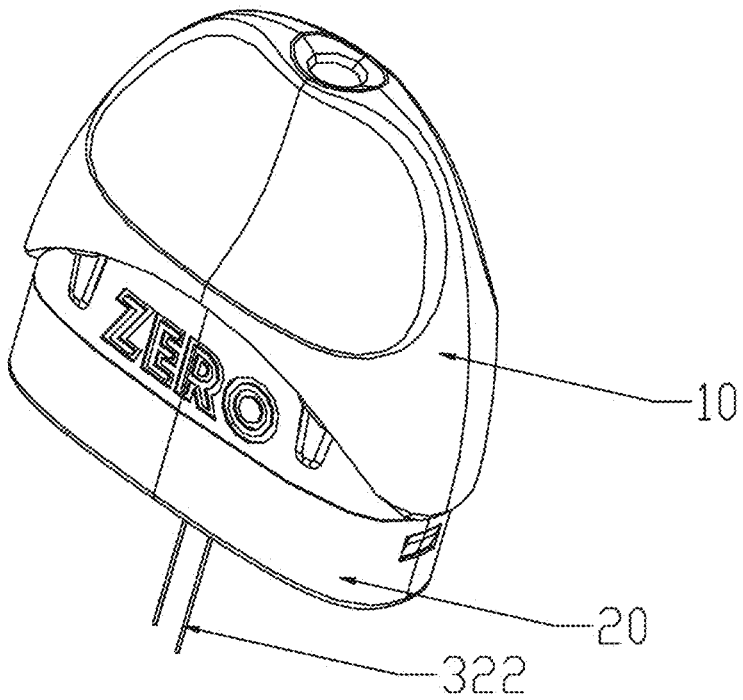
FIG. 9 is a schematic structural diagram 1 of a vaporizer according to the present invention.
Figure 10:
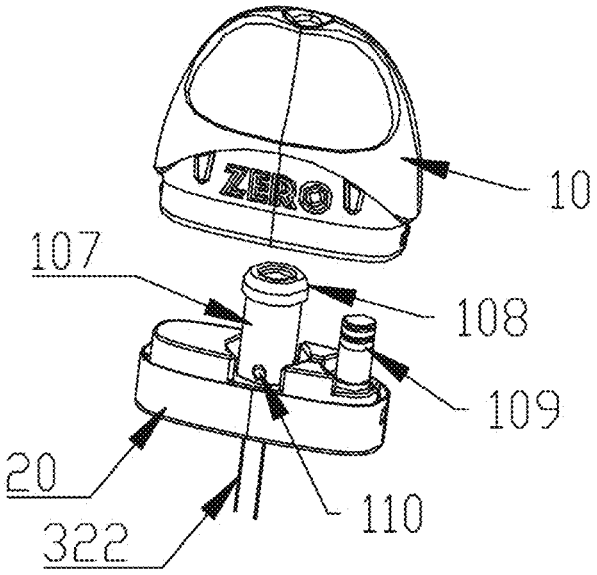
FIG. 10 is a schematic structural diagram 2 of a vaporizer according to the present invention.
Figure 11:
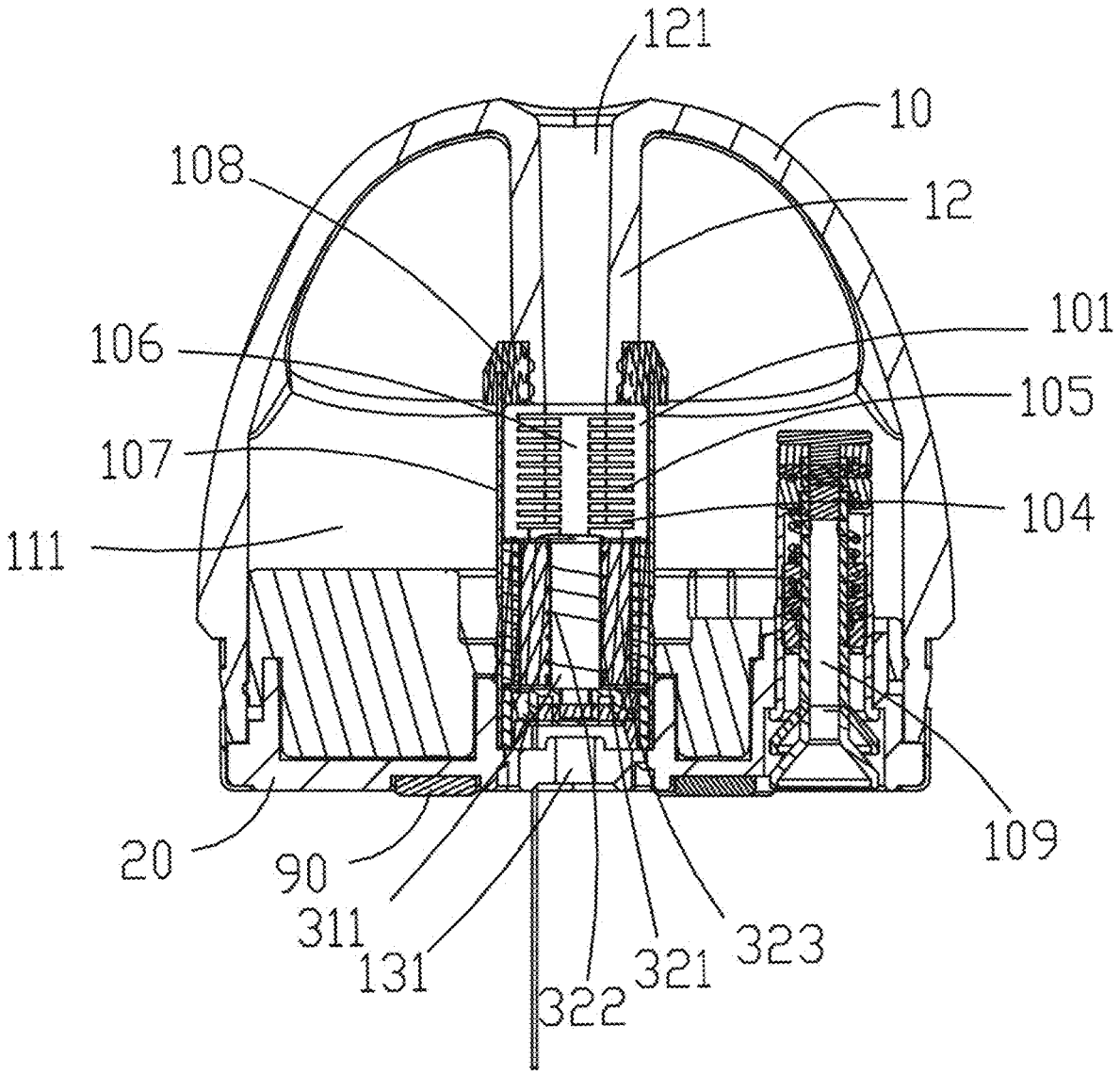
FIG. 11 is a schematic cross-sectional structural view of a vaporizer according to the present invention.

FIG. 9, FIG. 10, FIG. 11, and FIG. 13 to FIG. 17 show a third embodiment of a vaporizer of the present invention. As shown in FIG. 9, FIG. 10, and FIG. 11, the present invention constructs a vaporizer, including a base 20, a housing 10 sleeved on the base 20 and connected to the base 20 in a sealing manner to form a liquid storage cavity 111, an electrode 90 disposed on a bottom of the base 20, a liquid injection component 109 mounted on the base 20 and injecting liquid to the liquid storage cavity 111, a vaporizer body disposed on the base 20, an airflow channel running through the entire vaporizer, and a first liquid absorbing structure and a second liquid absorbing structure. The base includes a liquid storage structure, and for the liquid storage structure, reference may be made to the first embodiment, which is not described herein again. The vaporizer body includes a vaporization component 30, the airflow channel includes an air inlet channel 131, a vaporization cavity 311, and an air outlet channel 121, and the first liquid absorbing structure and the second liquid absorbing structure are in fluid connection on the air outlet channel 121. The first liquid absorbing structure and the second liquid absorbing structure absorb condensed liquid formed on the air outlet channel 121 through capillary force. The second liquid absorbing structure is located between the vaporization component 30 and the first liquid absorbing structure, and the capillary force of the second liquid absorbing structure is greater than that of the first liquid absorbing structure. The second liquid absorbing structure is provided with a liquid storage groove 105 that absorbs and stores the condensed liquid through capillary force. The condensed liquid in the first liquid absorbing structure reaches the second liquid absorbing structure under the capillary force of the liquid storage groove 105 and is then absorbed and stored.

In this embodiment, the second liquid absorbing structure includes an inner wall, the inner wall concaves to form the liquid storage groove 105, and the inner wall of the second liquid absorbing structure encloses to form a part of the air outlet channel 121. The first liquid absorbing structure is a liquid absorbing groove 122 extending in a longitudinal direction along an inner wall of the air outlet channel 121, and one end of the liquid absorbing groove 122 is docked with the liquid storage groove 105.

In this embodiment, the air outlet channel 121 includes a first airway wall and a second airway wall that are detachable, the first liquid absorbing structure is formed on the first airway wall, and the second airway wall is an inner wall of the first liquid absorbing structure. As shown in FIG. 11, the housing 10 includes a body and an air outlet tube 12 longitudinally disposed in an inner cavity of the body. The second liquid absorbing structure is disposed below the air outlet tube 12, the first airway wall is the air outlet tube 12, the second airway wall is the inner wall of the first liquid absorbing structure, and the air outlet tube 12 and an inner cavity of the second liquid absorbing structure form a complete air outlet channel 121.

In other embodiments, the second liquid absorbing structure may be formed on an integrally formed separate element. For example, the air outlet tube 12 and the vaporization component 30 are disposed adjacent to each other in a longitudinal direction, the second liquid absorbing structure and the air outlet tube 12 may be an integral structure, and the liquid storage groove 105 is opened on an inner wall surface of the air outlet tube 12. In this embodiment, the second liquid absorbing structure and the air outlet channel 12 are split structures. The second liquid absorbing structure includes a cylinder-shaped body disposed right above the vaporization component 30, and the air inlet channel 131, the vaporization cavity 311, the inner cavity of the second liquid absorbing structure, and the air outlet tube 12 form a complete airflow channel.

Figure 13:
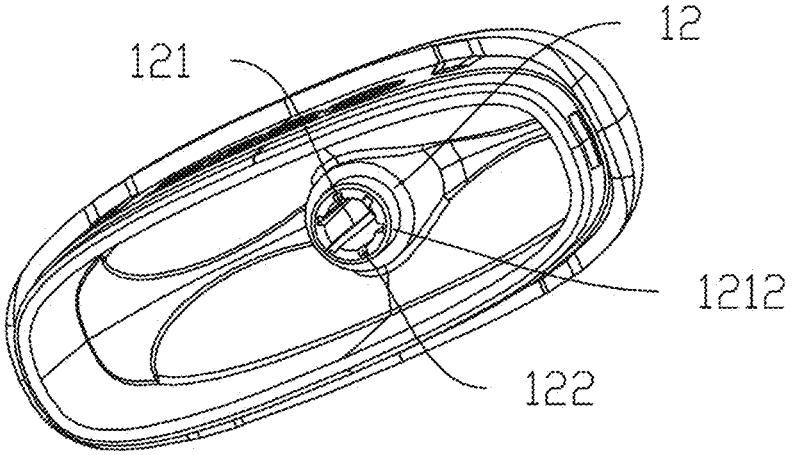
FIG. 13 is a schematic structural diagram 1 of an air outlet tube according to the present invention.
Figure 14:
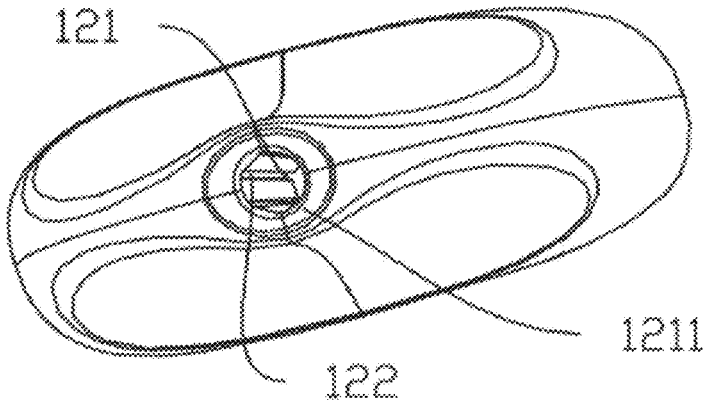
FIG. 14 is a schematic structural diagram 2 of an air outlet tube according to the present invention.

As shown in FIG. 13 and FIG. 14, the air outlet tube 12 includes a first end 1211 close to the vaporization component 30 and a second end 1212 away from the vaporization component 30. The liquid absorbing groove 122 is longitudinally disposed in an extending manner from the first end 1211 of the air outlet tube 12 to the second end 1212 of the air outlet tube 12, there are a plurality of liquid absorbing grooves 122 uniformly distributed along a peripheral wall of the air outlet channel 121, and the liquid absorbing grooves are parallel to a central axis of the air outlet channel 121. The first liquid absorbing structure may be detachably connected or fixedly connected to the inner sidewall of the air outlet tube 12. In this embodiment, the first liquid absorbing structure is fixedly connected to the inner sidewall of the air outlet tube 12, that is, the first liquid absorbing structure and the air outlet tube 12 are an integral structure. The inner sidewall of the air outlet tube 12 is provided with at least one liquid absorbing groove 122 extending longitudinally, and the liquid absorbing groove 122 is not limited to being disposed longitudinally, but may be disposed spirally or obliquely, or a surface of the inner sidewall is set to rough surface texture to increase surface wettability to condensed liquid. In other embodiments, a leaked liquid guiding element is fixed on the inner sidewall of the air outlet tube 12 through detachable connection in a manner of sticking or clamping.

As shown in FIG. 11, the vaporization component 30 includes a cylinder-shaped vaporization core 321, a liquid guiding cotton 323 surrounding the vaporization core 321, and a heating element 322 wound on the vaporization core 321. A conductive connection portion of the heating element 322 runs through the base 20 to be connected to an electrode 90. In some embodiments, the heating element 322 may be a heating wire. In a use process, the liquid guiding cotton 323 absorbs e-liquid in the liquid storage cavity 111, and the heating element 322 is powered on and generates heat, to vaporize the e-liquid in the vaporization core 321. A user inhales vapor through an inhaling opening of a top cover of the vaporizer, air enters the vaporization core 321 through the air inlet channel under action of suction force and is mixed with the vaporized e-liquid in the vaporization cavity 311 of the vaporization core 321, and is then exhausted from the inhaling opening of the top cover of the vaporizer after passing through the air outlet channel 121.

When vapor reaches an air outlet through the air outlet channel 121, airflow around the air outlet channel 121 is condensed when encountering the inner sidewall of the air outlet tube 12 to form e-liquid condensed liquid, and in this case, the liquid absorbing groove 122 absorbs the condensed liquid into the groove through capillary force. Since the capillary force of the liquid storage groove 105 is greater than the capillary force of the liquid absorbing groove 122, the condensed liquid in the liquid absorbing groove 122 reaches the second liquid absorbing structure under action of the capillary force of the liquid storage groove 105 to be absorbed and stored.

To make the condensed liquid absorbed into the liquid absorbing groove 122 to better reflux to the second liquid absorbing structure under the capillary force of the liquid storage groove 105 and to be absorbed and stored by the second liquid absorbing structure, a groove depth of the liquid absorbing groove 122 is set as gradually increasing in a direction to the liquid storage groove 105. That is, the groove depth gradually increases in a direction from the second end 1212 to the first end 1211, and preferably, the groove depth of the liquid absorbing groove 122 is greater than or equal to 0.1 mm.

A groove width of the liquid absorbing groove 122 may be further set as gradually increasing in the direction to the liquid storage groove 105. That is, the groove width gradually increases in the direction from the second end 1212 to the first end 1211, and the groove width of the liquid absorbing groove 122 is set as gradually increasing in a direction from a bottom to an opening of the liquid absorbing groove, preferably, the groove width of the liquid absorbing groove 122 is 0.05 mm to 1 mm.

Based on the embodiment of the first liquid absorbing structure, a bottom of the second liquid absorbing structure abuts against the liquid guiding cotton 323 of the vaporization component 30, and the bottom of the second liquid absorbing structure is provided with a reflux structure to make the liquid storage groove 105 to be in fluid connection to the liquid guiding cotton 323, so that the condensed liquid in the liquid storage groove 105 refluxes to the liquid guiding cotton 323 to be absorbed and utilized again. The reflux structure is a reflux groove, a liquid outlet, or a stage structure.

Figure 15:
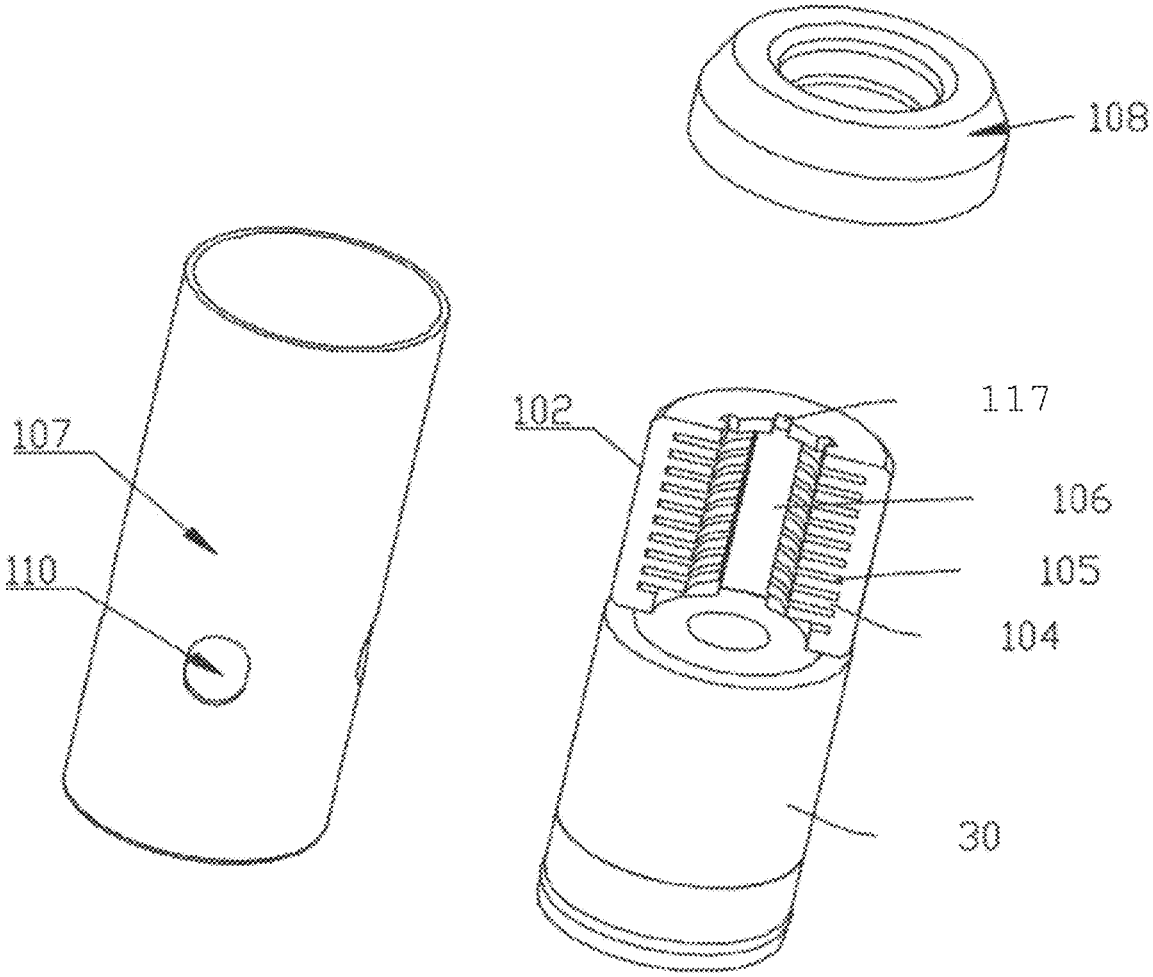
FIG. 15 is a schematic structural diagram of a vaporization component, a sleeve, a transverse liquid storage groove, and a sealing element according to the present invention.

As shown in FIG. 15, in some embodiments, the liquid storage groove 105 is a transverse liquid storage groove. Specifically, the inner wall of the second liquid absorbing structure is provided with a plurality of first fins 104. The first fins 104 are longitudinally disposed in parallel and at intervals, and a transverse liquid storage groove is formed between every two adjacently disposed first fins 104. A width of the liquid storage groove 105 is small enough to generate capillary force to the condensed liquid, so that liquid drips carried in vapor generated in an inhaling process may stay in the liquid storage groove 105 due to the structure of the first fins 104, thereby forming a liquid film in the liquid storage groove 105 and further being stored in the liquid storage groove 105, and preventing leaked liquid from being inhaled.

To prevent e-liquid accumulated in the liquid storage groove 105 in the second liquid absorbing structure from being brought out by inhaling due to an excessive amount and implement reuse of the condensed liquid, in this embodiment, the second liquid absorbing structure includes: at least one liquid reflux groove 106 extending longitudinally. The at least one liquid reflux groove 106 longitudinally cuts at least a part of the liquid storage groove 105, and the liquid reflux groove 106 is used for guiding, when an amount of the e-liquid accumulated in the liquid storage groove 105 is excessive, the e-liquid to reflux to the liquid guiding cotton 323 along the liquid reflux groove 106 to be absorbed and vaporized again. Preferably, two liquid reflux grooves 106 on the same diameter are disposed on the inner wall of the second liquid absorbing structure, the liquid reflux groove 106 longitudinally cuts from a next fin of a top first fin 104 of the second liquid absorbing structure to a bottom first fin 104, and the top first fin 104 of the second liquid absorbing structure is configured to prevent condensed liquid in the liquid reflux groove 106 from flowing to the air outlet channel 121.

To make refluxed e-liquid to be better absorbed by the liquid guiding cotton 323 and vaporized again, a length by which the bottom first fin 104 of the second liquid absorbing structure extends to a central axis of the second liquid absorbing structure is less than a length by which an adjacent first fin 104 extends to the central axis.

The condensed liquid in the liquid absorbing groove 122 may reach the second liquid absorbing structure under the capillary force of the liquid storage groove 105 to be absorbed and stored, so that the top first fin 104 of the second liquid absorbing structure is provided with a first liquid guiding opening 117 corresponding to the liquid absorbing groove 122 configured to guide the condensed liquid in the liquid absorbing groove 122 to flow to the liquid storage groove 105, to make the condensed liquid to be better absorbed and stored by the second liquid absorbing structure. Specifically, in this embodiment, the second liquid absorbing structure is in a shape of a cylinder, the top first fin 104 is in a shape of a circular ring, other fins are in a shape of a sector ring, and the first liquid guiding opening 117 is a notch opened at an edge of an inner circle.

The plurality of first fins 104 are disposed on an inner wall surface of the cylinder-shaped body. As shown in FIG. 15, the cylinder-shaped body includes a first part 102 and a second part (not shown in the figure) that may be detachably enclosed together, where inner wall surfaces of the first part 102 and the second part are provided with a plurality of first fins. Specifically, the second liquid absorbing structure is in a shape of a cylinder and may be formed by two semicircular cylinders through combination, the top first fin 104 is in a shape of a semi-circular ring, and other fins are in a shape of a sector ring.

Figure 16:
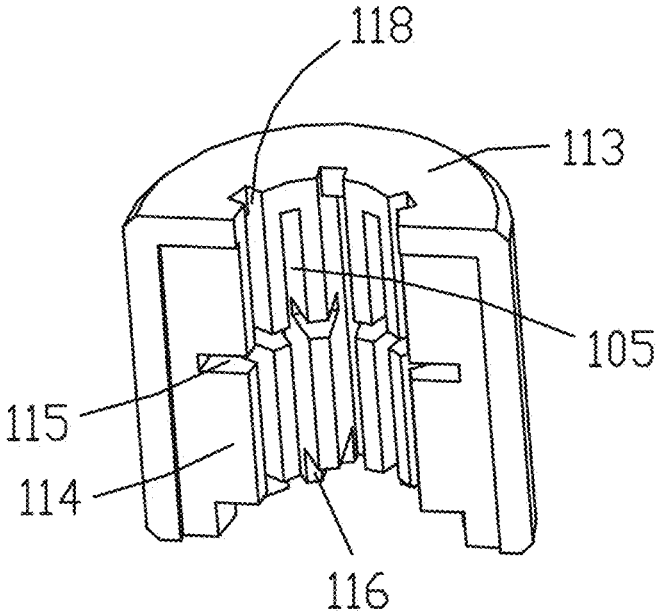
FIG. 16 is a schematic structural diagram 1 of a longitudinal liquid storage groove according to the present invention.
Figure 17:
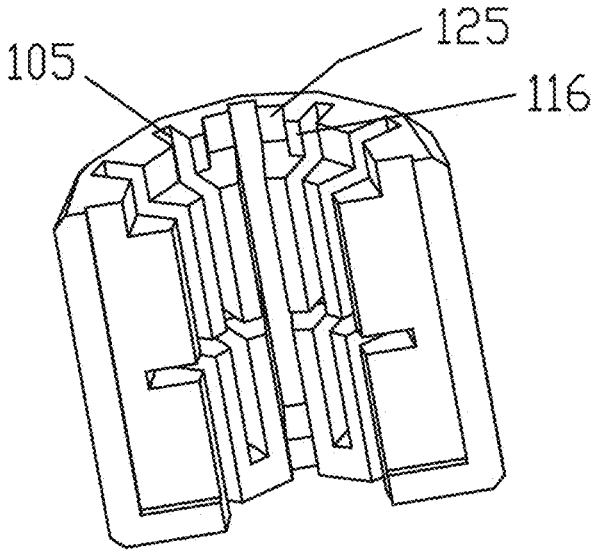
FIG. 17 is a schematic structural diagram 2 of a longitudinal liquid storage groove according to the present invention.

As shown in FIG. 16 and FIG. 17, in some embodiments, the liquid storage groove 105 is a longitudinal liquid storage groove. Specifically, the second liquid absorbing structure is a hollow structure, and a top thereof is provided with a top wall 113. A plurality of liquid storage plates 114 are disposed longitudinally in an extending manner from the top wall 113 to the bottom, the liquid storage plates 114 are disposed at intervals, and a liquid storage groove 105 is formed between every two adjacently disposed liquid storage plates 114.

To implement better liquid diverging and liquid absorbing, in this embodiment, the second liquid absorbing structure further includes at least one liquid guiding groove 115 in communication with a part of the liquid storage groove 105 and configured to diverge the condensed liquid, and the liquid guiding groove 115 crosscuts at least a part of a middle part of the liquid storage plate 114. In some embodiments, the liquid guiding groove 115 and the liquid storage groove 114 may not be necessarily parallel or perpendicular to each other provided that crossing liquid diverging can be implemented.

To implement liquid diverging at the bottom of the second liquid absorbing structure, the second liquid absorbing structure further includes: at least one first stage 116 crosscutting at least a part of the bottom of the liquid storage plate 114 for diverging the condensed liquid. In this embodiment, the first stage crosscuts bottoms of all the liquid storage plates 114.

To make the diverged condensed liquid to better reflux to the vaporization core and to be vaporized again, the at least one first stage 116 is provided with a second stage 125. In this embodiment, second stages 125 are opened on two first stages 116, and the first stages 116, the second stages 125, and the liquid storage groove 105 form a stage structure.

Similarly, the condensed liquid in the liquid absorbing groove 122 may reach the second liquid absorbing structure under the capillary force of the liquid storage groove 105 to be absorbed and stored, so that the top wall 113 of the second liquid absorbing structure is provided with a second liquid guiding opening 118 corresponding to the liquid absorbing groove 122. Specifically, in this embodiment, the second liquid absorbing structure is in a shape of a cylinder, the top wall 113 is in a shape of a circular ring, and the second liquid guiding opening 118 is a notch opened on an edge of an inner circle.

The plurality of liquid storage plates 114 are disposed on an inner wall surface of the cylinder-shaped body. The cylinder-shaped body includes a first part and a second part that may be detachably enclosed together, where inner wall surfaces of the first part and the second part are provided with a plurality of liquid storage plates 114. Specifically, the second liquid absorbing structure is in a shape of a cylinder and may be formed by two semicircular cylinders through combination.

In some embodiments, the liquid storage groove 105 is a threaded liquid storage groove and includes second fins 120 disposed spirally and linearly on an inner wall to form the liquid storage groove 105 in a threaded structure.

To make the condensed liquid in the liquid storage groove 105 to reflux to the vaporization core to be vaporized again, the second liquid absorbing structure includes at least one liquid outlet, and the liquid outlet longitudinally cuts second fins 120 of the bottom part.

The plurality of second fins 120 are disposed on an inner wall surface of the cylinder-shaped body. The cylinder-shaped body includes a first part and a second part that may be detachably enclosed together, where inner wall surfaces of the first part and the second part are provided with a plurality of second fins 120. Specifically, the second liquid absorbing structure is in a shape of a cylinder and may be formed by two semicircular cylinders through combination.

In the foregoing embodiments, a reason for disposing the second liquid absorbing structure right above the vaporization core 321 and adjacent to the vaporization core 321 is that: when an e-cigarette is heated, condensed liquid may be easily formed on an airway wall when vapor flows through the air outlet channel, and the second liquid absorbing structure disposed right above the vaporization component in the present invention may absorb liquid drips carried in the vapor and store the liquid drips in the liquid storage groove, thereby greatly reducing a possibility of inhaling leaked liquid.

Optionally, a groove depth of the liquid storage groove 105 is greater than or equal to 0.1 mm, and a groove width of the liquid storage groove 105 is 0.05 mm to 1 mm. A material of the second liquid absorbing structure may also be one or more of PETG, PCTG, and PC.

In this embodiment, as shown in FIG. 11, the vaporization component 30 and the second liquid absorbing structure may be alternatively disposed in the same sleeve 107. The second liquid absorbing structure and the vaporization component 30 are disposed adjacent to each other, and the sleeve 107 corresponding to the vaporization component 30 is provided with at least liquid inlet 110 configured to cause the e-liquid in the liquid storage cavity 111 to be absorbed by the liquid guiding cotton 323.

To fix the vaporization component 30 and the second liquid absorbing structure and make mounting more convenient, an outer sidewall of the second liquid absorbing structure and an inner sidewall of the sleeve 107 are disposed attached to each other. In some embodiments, the second liquid absorbing structure and the sleeve 107 may be an integral structure.

To seal the connection between the sleeve 107 and the air outlet channel 121, the sleeve 107 corresponding to the top of the second liquid absorbing structure is provided with a sealing element 108 connected to the air outlet channel 121 in a sealing manner, and the sealing element may be a silicone sleeve or a rubber sleeve. It may be understood that, in some other embodiments, the sealing sleeve is not limited to the silicone sleeve or the rubber sleeve.

As shown in FIG. 9, FIG. 10, and FIG. 11, the present invention further constructs an electronic vaporization apparatus, including a base 20, a housing 10 sleeved on the base 20 and connected to the base 20 in a sealing manner to form a liquid storage cavity 111, an electrode 90 disposed on a bottom of the base 20, a liquid injection component 109 mounted on the base 20 and injecting liquid to the liquid storage cavity 111, a vaporizer body disposed on the base 20, an airflow channel running through the entire vaporizer, and a first liquid absorbing structure and a second liquid absorbing structure. The vaporizer body includes a vaporization component 30, the airflow channel includes an air inlet channel 131, a vaporization cavity 311, and an air outlet channel 121, and the first liquid absorbing structure and the second liquid absorbing structure are in fluid connection on the air outlet channel 121. The first liquid absorbing structure and the second liquid absorbing structure absorb condensed liquid formed on the air outlet channel 121 through capillary force. The second liquid absorbing structure is located between the vaporization component 30 and the first liquid absorbing structure, and the capillary force of the second liquid absorbing structure is greater than that of the first liquid absorbing structure. The second liquid absorbing structure is provided with a liquid storage groove 105 that absorbs and stores the condensed liquid through capillary force. The condensed liquid in the first liquid absorbing structure reaches the second liquid absorbing structure under the capillary force of the liquid storage groove 105 and is then absorbed and stored. In this embodiment, the electronic vaporization apparatus is a disposable vaporization apparatus in which the base, the housing, and the vaporizer body are an integral structure, or may be a vaporization apparatus in which the base, the housing, the vaporizer body are split structures.

In this embodiment, the second liquid absorbing structure includes an inner wall, the inner wall concaves to form the liquid storage groove 105, and the inner wall of the second liquid absorbing structure encloses to form a part of the air outlet channel 121. The first liquid absorbing structure is a liquid absorbing groove 122 extending in a longitudinal direction along an inner wall of the air outlet channel 121, and one end of the liquid absorbing groove 122 is docked with the liquid storage groove 105.

In this embodiment, the air outlet channel 121 includes a first airway wall and a second airway wall that are detachable, the first liquid absorbing structure is formed on the first airway wall, and the second airway wall is an inner wall of the first liquid absorbing structure. As shown in FIG. 11, the housing 10 includes a body and an air outlet tube 12 longitudinally disposed in an inner cavity of the body. The second liquid absorbing structure is disposed below the air outlet tube 12, the first airway wall is the air outlet tube 12, the second airway wall is the inner wall of the first liquid absorbing structure, and the air outlet tube 12 and an inner cavity of the second liquid absorbing structure form a complete air outlet channel 121.

In other embodiments, the second liquid absorbing structure is formed on an integrally formed separate element. For example, the air outlet tube 12 and the vaporization component 30 are disposed adjacent to each other in a longitudinal direction, the second liquid absorbing structure and the air outlet tube 12 may be an integral structure, and the liquid storage groove 105 is opened on an inner wall surface of the air outlet tube 12. In this embodiment, the second liquid absorbing structure and the air outlet channel 12 are split structures. The second liquid absorbing structure includes a cylinder-shaped body disposed right above the vaporization component 30, and the air inlet channel 131, the vaporization cavity 311, the inner cavity of the second liquid absorbing structure, and the air outlet tube 12 form a complete airflow channel.

As shown in FIG. 13 and FIG. 14, the air outlet tube 12 includes a first end 1211 close to the vaporization component 30 and a second end 1212 away from the vaporization component 30. The liquid absorbing groove 122 is longitudinally disposed in an extending manner from the first end 1211 of the air outlet tube 12 to the second end 1212 of the air outlet tube 12, there are a plurality of liquid absorbing grooves 122 uniformly distributed along a peripheral wall of the air outlet channel 121, and the liquid absorbing grooves are parallel to a central axis of the air outlet channel 121. The first liquid absorbing structure may be detachably connected or fixedly connected to the inner sidewall of the air outlet tube 12. In this embodiment, the first liquid absorbing structure is fixedly connected to the inner sidewall of the air outlet tube 12, that is, the first liquid absorbing structure and the air outlet tube 12 are an integral structure. The inner sidewall of the air outlet tube 12 is provided with at least one liquid absorbing groove 122 extending longitudinally, and the liquid absorbing groove 122 is not limited to being disposed longitudinally, but may be disposed spirally or obliquely, or a surface of the inner sidewall is set to rough surface texture to increase surface wettability to condensed liquid. In other embodiments, a leaked liquid guiding element is fixed on the inner sidewall of the air outlet tube 12 through detachable connection in a manner of sticking or clamping.

As shown in FIG. 11, the vaporization component 30 includes a cylinder-shaped vaporization core 321, a liquid guiding cotton 323 surrounding the vaporization core 321, and a heating element 322 wound on the vaporization core 321. A conductive connection portion of the heating element 322 runs through the base 20 to be connected to an electrode 90. In some embodiments, the heating element 322 may be a heating wire. In a use process, the liquid guiding cotton 323 absorbs e-liquid in the liquid storage cavity 111, and the heating element 322 is powered on and generates heat, to vaporize the e-liquid in the vaporization core 321. A user inhales vapor through an inhaling opening of a top cover of the vaporizer, air enters the vaporization core 321 through the air inlet channel under action of suction force and is mixed with the vaporized e-liquid in the vaporization cavity 311 of the vaporization core 321, and is then exhausted from the inhaling opening of the top cover of the vaporizer after passing through the air outlet channel 121.

When vapor reaches an air outlet through the air outlet channel 121, airflow around the air outlet channel 121 is condensed when encountering the inner sidewall of the air outlet tube 12 to form e-liquid condensed liquid, and in this case, the liquid absorbing groove 122 absorbs the condensed liquid into the groove through capillary force. Since the capillary force of the liquid storage groove 105 is greater than the capillary force of the liquid absorbing groove 122, the condensed liquid in the liquid absorbing groove 122 reaches the second liquid absorbing structure under action of the capillary force of the liquid storage groove 105 to be absorbed and stored.

To make the condensed liquid absorbed into the liquid absorbing groove 122 to better reflux to the second liquid absorbing structure under the capillary force of the liquid storage groove 105 and to be absorbed and stored by the second liquid absorbing structure, a groove depth of the liquid absorbing groove 122 is set as gradually increasing in a direction to the liquid storage groove 105. That is, the groove depth gradually increases in a direction from the second end 1212 to the first end 1211, and preferably, the groove depth of the liquid absorbing groove 122 is greater than or equal to 0.1 mm.

A groove width of the liquid absorbing groove 122 may be further set as gradually increasing in the direction to the liquid storage groove 105. That is, the groove width gradually increases in the direction from the second end 1212 to the first end 1211, and the groove width of the liquid absorbing groove 122 is set as gradually increasing in a direction from a bottom to an opening of the liquid absorbing groove, preferably, the groove width of the liquid absorbing groove 122 is 0.05 mm to 1 mm.

Based on the embodiment of the first liquid absorbing structure, a bottom of the second liquid absorbing structure abuts against the liquid guiding cotton 323 of the vaporization component 30, and the bottom of the second liquid absorbing structure is provided with a reflux structure to make the liquid storage groove 105 to be in fluid connection to the liquid guiding cotton 323, so that the condensed liquid in the liquid storage groove 105 refluxes to the liquid guiding cotton 323 to be absorbed and utilized again. The reflux structure is a reflux groove, a liquid outlet, or a stage structure.

As shown in FIG. 15, in some embodiments, the liquid storage groove 105 is a transverse liquid storage groove. Specifically, the inner wall of the second liquid absorbing structure is provided with a plurality of first fins 104. The first fins 104 are longitudinally disposed in parallel and at intervals, and a transverse liquid storage groove is formed between every two adjacently disposed first fins 104. A width of the liquid storage groove 105 is small enough to generate capillary force to the condensed liquid, so that liquid drips carried in vapor generated in an inhaling process may stay in the liquid storage groove 105 due to the structure of the first fins 104, thereby forming a liquid film in the liquid storage groove 105 and further being stored in the liquid storage groove 105, and preventing leaked liquid from being inhaled.

To prevent e-liquid accumulated in the liquid storage groove 105 in the second liquid absorbing structure from being brought out by inhaling due to an excessive amount and implement reuse of the condensed liquid, in this embodiment, the second liquid absorbing structure includes: at least one liquid reflux groove 106 extending longitudinally. The at least one liquid reflux groove 106 longitudinally cuts at least a part of the liquid storage groove 105, and the liquid reflux groove 106 is used for guiding, when an amount of the e-liquid accumulated in the liquid storage groove 105 is excessive, the e-liquid to reflux to the liquid guiding cotton 323 along the liquid reflux groove 106 to be absorbed and vaporized again. Preferably, two liquid reflux grooves 106 on the same diameter are disposed on the inner wall of the second liquid absorbing structure, the liquid reflux groove 106 longitudinally cuts from a next fin of a top first fin 104 of the second liquid absorbing structure to a bottom first fin 104, and the top first fin 104 of the second liquid absorbing structure is configured to prevent condensed liquid in the liquid reflux groove 106 from flowing to the air outlet channel 121.

To make refluxed e-liquid to be better absorbed by the liquid guiding cotton 323 and vaporized again, a length by which the bottom first fin 104 of the second liquid absorbing structure extends to a central axis of the second liquid absorbing structure is less than a length by which an adjacent first fin 104 extends to the central axis.

The condensed liquid in the liquid absorbing groove 122 may reach the second liquid absorbing structure under the capillary force of the liquid storage groove 105 to be absorbed and stored, so that the top first fin 104 of the second liquid absorbing structure is provided with a first liquid guiding opening 117 corresponding to the liquid absorbing groove 122 configured to guide the condensed liquid in the liquid absorbing groove 122 to flow to the liquid storage groove 105, to make the condensed liquid to be better absorbed and stored by the second liquid absorbing structure. Specifically, in this embodiment, the second liquid absorbing structure is in a shape of a cylinder, the top first fin 104 is in a shape of a circular ring, other fins are in a shape of a sector ring, and the first liquid guiding opening 117 is a notch opened at an edge of an inner circle.

The plurality of first fins 104 are disposed on an inner wall surface of the cylinder-shaped body. As shown in FIG. 15, the cylinder-shaped body includes a first part 102 and a second part (not shown in the figure) that may be detachably enclosed together, where inner wall surfaces of the first part 102 and the second part are provided with a plurality of first fins. Specifically, the second liquid absorbing structure is in a shape of a cylinder and may be formed by two semicircular cylinders through combination, the top first fin 104 is in a shape of a semi-circular ring, and other fins are in a shape of a sector ring.

As shown in FIG. 16 and FIG. 17, in some embodiments, the liquid storage groove 105 is a longitudinal liquid storage groove. Specifically, the second liquid absorbing structure is a hollow structure, and a top thereof is provided with a top wall 113. A plurality of liquid storage plates 114 are disposed longitudinally in an extending manner from the top wall 113 to the bottom, the liquid storage plates 114 are disposed at intervals, and a liquid storage groove 105 is formed between every two adjacently disposed liquid storage plates 114.

To implement better liquid diverging and liquid absorbing, in this embodiment, the second liquid absorbing structure further includes at least one liquid guiding groove 115 in communication with a part of the liquid storage groove 105 and configured to diverge the condensed liquid, and the liquid guiding groove 115 crosscuts at least a part of a middle part of the liquid storage plate 114. In some embodiments, the liquid guiding groove 115 and the liquid storage groove 114 may not be necessarily parallel or perpendicular to each other provided that crossing liquid diverging can be implemented.

To implement liquid diverging at the bottom of the second liquid absorbing structure, the second liquid absorbing structure further includes: at least one first stage 116 crosscutting at least a part of the bottom of the liquid storage plate 114 for diverging the condensed liquid. In this embodiment, the first stage crosscuts bottoms of all the liquid storage plates 114.

To make the diverged condensed liquid to better reflux to the vaporization core and to be vaporized again, the at least one first stage 116 is provided with a second stage 125. In this embodiment, second stages 125 are opened on two first stages 116, and the first stages 116, the second stages 125, and the liquid storage groove 105 form a stage structure.

Similarly, the condensed liquid in the liquid absorbing groove 122 may reach the second liquid absorbing structure under the capillary force of the liquid storage groove 105 to be absorbed and stored, so that the top wall 113 of the second liquid absorbing structure is provided with a second liquid guiding opening 118 corresponding to the liquid absorbing groove 122. Specifically, in this embodiment, the second liquid absorbing structure is in a shape of a cylinder, the top wall 113 is in a shape of a circular ring, and the second liquid guiding opening 118 is a notch opened on an edge of an inner circle.

The plurality of liquid storage plates 114 are disposed on an inner wall surface of the cylinder-shaped body. The cylinder-shaped body includes a first part and a second part that may be detachably enclosed together, where inner wall surfaces of the first part and the second part are provided with a plurality of liquid storage plates 114. Specifically, the second liquid absorbing structure is in a shape of a cylinder and may be formed by two semicircular cylinders through combination.

In some embodiments, the liquid storage groove 105 is a threaded liquid storage groove and includes second fins 120 disposed spirally and linearly on an inner wall to form the liquid storage groove 105 in a threaded structure.

To make the condensed liquid in the liquid storage groove 105 to reflux to the vaporization core to be vaporized again, the second liquid absorbing structure includes at least one liquid outlet, and the liquid outlet longitudinally cuts second fins 120 of the bottom part.

The plurality of second fins 120 are disposed on an inner wall surface of the cylinder-shaped body. The cylinder-shaped body includes a first part and a second part that may be detachably enclosed together, where inner wall surfaces of the first part and the second part are provided with a plurality of second fins 120. Specifically, the second liquid absorbing structure is in a shape of a cylinder and may be formed by two semicircular cylinders through combination.

In the foregoing embodiments, a reason for disposing the second liquid absorbing structure right above the vaporization core 321 and adjacent to the vaporization core 321 is that: when an e-cigarette is heated, condensed liquid may be easily formed on an airway wall when vapor flows through the air outlet channel, and the second liquid absorbing structure disposed right above the vaporization component in the present invention may absorb liquid drips carried in the vapor and store the liquid drips in the liquid storage groove, thereby greatly reducing a possibility of inhaling leaked liquid.

Optionally, a groove depth of the liquid storage groove 105 is greater than or equal to 0.1 mm, and a groove width of the liquid storage groove 105 is 0.05 mm to 1 mm. A material of the second liquid absorbing structure may also be one or more of PETG, PCTG, and PC.

In this embodiment, as shown in FIG. 11, the vaporization component 30 and the second liquid absorbing structure may be alternatively disposed in the same sleeve 107. The second liquid absorbing structure and the vaporization component 30 are disposed adjacent to each other, and the sleeve 107 corresponding to the vaporization component 30 is provided with at least liquid inlet 110 configured to cause the e-liquid in the liquid storage cavity 111 to be absorbed by the liquid guiding cotton 323.

To fix the vaporization component 30 and the second liquid absorbing structure and make mounting more convenient, an outer sidewall of the second liquid absorbing structure and an inner sidewall of the sleeve 107 are disposed attached to each other. In some embodiments, the second liquid absorbing structure and the sleeve 107 may be an integral structure.

To seal the connection between the sleeve 107 and the air outlet channel 121, the sleeve 107 corresponding to the top of the second liquid absorbing structure is provided with a sealing element 108 connected to the air outlet channel 121 in a sealing manner, and the sealing element may be a silicone sleeve or a rubber sleeve. It may be understood that, in some other embodiments, the sealing sleeve is not limited to the silicone sleeve or the rubber sleeve.

Implementation of the third embodiment has the following beneficial effects:

In the present invention, a first liquid storage structure and a second liquid storage structure that are in fluid connection are disposed on an air outlet channel, the first liquid storage structure and the second liquid storage structure absorb condensed liquid formed on the air outlet channel through capillary force, the second liquid storage structure is located between a vaporization component and the first liquid absorbing structure, and the capillary force of the second liquid absorbing structure is greater than that of the first liquid absorbing structure. The second liquid absorbing structure is provided with a liquid storage groove that absorbs and stores the condensed liquid through capillary force, the condensed liquid in the first liquid absorbing structure reaches the second liquid absorbing structure under the capillary force of the liquid storage groove to be absorbed and stored, so that e-liquid that is not completely vaporized in an inhaling process and the condensed liquid generated on the air outlet channel are absorbed and stored, thereby preventing a user from inhaling leaked liquid in the inhaling process and improving user's use experience.

In addition, in the present invention, a bottom of the second liquid absorbing structure abuts against the liquid guiding cotton 323, and the bottom of the second liquid absorbing structure is provided with a reflux structure to make the liquid storage groove to be in fluid connection to the liquid guiding cotton 323, so that the condensed liquid in the liquid storage groove is recycled to the liquid guiding cotton 323 to be vaporized again, thereby improving utilization of the e-liquid.

When an e-cigarette is heated, condensed liquid may be easily formed on an airway wall when vapor flows through the air outlet channel, and the second liquid absorbing structure disposed right above the vaporization component in the present invention may absorb liquid drips carried in the vapor and store the liquid drips in the liquid storage groove, thereby greatly reducing a possibility of inhaling leaked liquid.

It may be understood that, the foregoing embodiments only describe preferred implementations of the present invention specifically and in detail, but cannot be construed as a limitation to the patent scope of the present invention. It should be noted that a person of ordinary skill in the art may combine the foregoing technical features freely or may further make several variations and improvements without departing from the concept of the present invention, and these variations and improvements all fall within the protection scope of the present invention. Therefore, equivalent changes and modifications made according to the scope of the claims of the present invention all fall within the scope of the claims of the present invention.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A vaporizer, comprising:

a vaporization component having a vaporization cavity;

an air outlet channel comprising a first end close to the vaporization component and a second end away from the vaporization component; and a liquid absorbing structure disposed between the vaporization component and the air outlet channel, wherein, during inhaling by a user of the vaporizer, vapor formed by the vaporization component reaches a mouth of the user through the air outlet channel, wherein an inner sidewall of the air outlet channel is provided with at least one first liquid absorbing groove, wherein the at least one first liquid absorbing groove extends from the first end of the air outlet channel to the second end of the air outlet channel and is configured to absorb condensed liquid formed on the inner sidewall of the air outlet channel through capillary force, wherein an end surface of the first end of the air outlet channel is provided with an outlet that is in communication with the at least one first liquid absorbing groove and the vaporization component such that liquid in the at least one first liquid absorbing groove drips onto the vaporization component through the outlet, wherein a groove depth of the at least one first liquid absorbing groove decreases from the first end to the second end of the air outlet channel, wherein a groove width of the at least one first liquid absorbing groove increases from the first end to the second end of the air outlet channel, wherein the liquid absorbing structure comprises at least one liquid guiding opening corresponding to the at least one first liquid absorbing groove, wherein the liquid absorbing structure further comprises a plurality of fins longitudinally disposed in parallel and at intervals, and wherein a liquid storage groove is formed between two adjacent fins from the plurality of fins.

2. The vaporizer of claim 1, wherein the at least one first liquid absorbing groove extends from the first end of the air outlet channel to the second end of the air outlet channel such that the condensed liquid absorbed by the at least one first liquid absorbing groove flows to the vaporization component by gravity.

3. The vaporizer of claim 2, wherein the at least one first liquid absorbing groove and a central axis of the air outlet channel are parallel.

4. The vaporizer of claim 2, wherein the at least one first liquid absorbing groove is spirally disposed.

5. The vaporizer of claim 2, wherein the vaporization component is configured to vaporize the condensed liquid flowing from the at least one first liquid absorbing groove again.

6. The vaporizer of claim 2, wherein the at least one first liquid absorbing groove is in direct communication with the vaporization cavity.

7. The vaporizer of claim 2, wherein the at least one first liquid absorbing groove comprises a plurality of first liquid absorbing grooves, and wherein the plurality of first liquid absorbing grooves are disposed at intervals and parallel to each other.

8. The vaporizer of claim 7, wherein a groove depth of each first liquid absorbing groove of the plurality of first liquid absorbing grooves decreases as each first liquid absorbing groove approaches the vaporization component, wherein a groove width of each first liquid absorbing groove of the plurality of first liquid absorbing grooves increases in an opening direction of the first liquid absorbing groove such that an inner part of the first liquid absorbing groove is narrow and an opening of the first liquid absorbing groove is wide so as to help the liquid flow onto the vaporization component along the first liquid absorbing groove.

9. The vaporizer of claim 7, wherein the groove depth of each first liquid absorbing groove of the plurality of first liquid absorbing grooves is greater than or equal to 0.1 mm.

10. The vaporizer of claim 7, wherein a groove width of each first liquid absorbing groove of the plurality of first liquid absorbing grooves is 0.05 mm to 1 mm.

11. The vaporizer of claim 7, wherein a groove width of each first liquid absorbing groove of the plurality of first liquid absorbing grooves increases in a direction from a bottom to an opening of the respective first liquid absorbing groove.

12. The vaporizer of claim 1, further comprising:

a housing; and a base, wherein the housing is sleeved on the base, the vaporization component is disposed on the base, and a sidewall of the air outlet channel and the housing are integrally formed.

13. The vaporizer of claim 12, wherein the housing comprises a body and an air outlet tube longitudinally disposed in the body, wherein the air outlet channel is disposed in the air outlet tube, wherein the at least one first liquid absorbing groove is disposed on an inner sidewall of the air outlet tube, and wherein an inner side of the body and an outside of the air outlet tube form a liquid storage cavity in fluid connection with the vaporization component.

14. An electronic vaporization apparatus, comprising:

a vaporization component having a vaporization cavity;

an air outlet channel comprising a first end close to the vaporization component and a second end away from the vaporization component; and a liquid absorbing structure disposed between the vaporization component and the air outlet channel, wherein during inhaling by a user of the electronic vaporization apparatus, vapor formed by the vaporization component reaches a mouth of the user through the air outlet channel, wherein an inner sidewall of the air outlet channel is provided with at least one first liquid absorbing groove extends from the first end of the air outlet channel to the second end of the air outlet channel and, and wherein the at least one first liquid absorbing groove is configured to absorb condensed liquid formed on the inner sidewall of the air outlet channel through capillary force, wherein an end surface of the first end of the air outlet channel is provided with an outlet that is in communication with the at least one first liquid absorbing groove and the vaporization component such that liquid in the at least one first liquid absorbing groove drips onto the vaporization component through the outlet, wherein a groove depth of the at least one first liquid absorbing groove decreases from the first end to the second end of the air outlet channel, wherein a groove width of the at least one first liquid absorbing groove increases from the first end to the second end of the air outlet channel, wherein the liquid absorbing structure comprises at least one liquid guiding opening corresponding to the at least one first liquid absorbing groove, wherein the liquid absorbing structure further comprises a plurality of liquid storage plates disposed at intervals and extending from a top wall of the liquid absorbing structure to a bottom of the liquid absorbing structure, and wherein a liquid storage groove is formed between two adjacent liquid storage plates from the plurality of liquid storage plates.

15. The electronic vaporization apparatus of claim 14, wherein the at least one first liquid absorbing groove extends from the first end of the air outlet channel to the second end of the air outlet channel such that the condensed liquid absorbed by the at least one first liquid absorbing groove flows to the vaporization component by gravity.

16. The electronic vaporization apparatus of claim 15, wherein the at least one first liquid absorbing groove and a central axis of the air outlet channel are parallel.

17. The electronic vaporization apparatus of claim 15, wherein the at least one first liquid absorbing groove is spirally disposed.

18. The electronic vaporization apparatus of claim 15, wherein the vaporization component is configured to vaporize the condensed liquid flowing from the at least one first liquid absorbing groove again, and wherein the at least one first liquid absorbing groove is in direct communication with the vaporization cavity.

19. The electronic vaporization apparatus of claim 15, wherein the at least one first liquid absorbing groove comprises a plurality of first liquid absorbing grooves, wherein a groove width of each first liquid absorbing groove of the plurality of first liquid absorbing grooves increases in a direction away from the second end, and/or wherein a groove width of each first liquid absorbing groove of the plurality of first liquid absorbing grooves increases in a direction from a bottom of the respective first liquid absorbing groove to an opening of the respective first liquid absorbing groove.

20. A vaporizer, comprising:

a vaporization component having a vaporization cavity; and an air outlet channel comprising a first end close to the vaporization component and a second end away from the vaporization component;

wherein an inner sidewall of the air outlet channel is provided with at least one first liquid absorbing groove, wherein the at least one first liquid absorbing groove extends in a first direction from the first end of the air outlet channel to the second end of the air outlet channel and is configured to absorb condensed liquid formed on the inner sidewall of the air outlet channel through capillary force, wherein a groove width or a groove depth of the at least one first liquid absorbing groove increases from the first end to the second end of the air outlet channel, wherein the air outlet channel further comprises a liquid absorbing structure disposed adjacent to the vaporization component and connecting the at least one liquid absorbing groove, wherein the liquid absorbing structure further comprises a plurality of fins disposed in parallel and at intervals, wherein a liquid storage groove is formed between two adjacent fins from the plurality of fins, and wherein the liquid storage groove extends in a second direction different from the first direction in which the at least one first liquid absorbing groove extends.

* * * * *